US008016381B2

(12) United States Patent
Watanabe et al.

(10) Patent No.: US 8,016,381 B2
(45) Date of Patent: Sep. 13, 2011

(54) LIQUID EJECTING APPARATUS AND METHOD OF CONTROLLING SAME

(75) Inventors: Eiichiro Watanabe, Matsumoto (JP); Tomoji Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 481 days.

(21) Appl. No.: 12/203,769

(22) Filed: Sep. 3, 2008

(65) Prior Publication Data

US 2009/0073201 A1 Mar. 19, 2009

(30) Foreign Application Priority Data

Sep. 4, 2007 (JP) ..... 2007-229301
Feb. 14, 2008 (JP) ..... 2008-033805
Aug. 6, 2008 (JP) ..... 2008-203285

(51) Int. Cl.
*B41J 2/165* (2006.01)

(52) U.S. Cl. ..... 347/23

(58) Field of Classification Search ..... 347/9, 22, 347/23

See application file for complete search history.

(56) References Cited

U.S. PATENT DOCUMENTS 6,595,616 B2 * 7/2003 Takahashi et al. ..... 347/23
7,232,204 B2 * 6/2007 Koike et al. ..... 347/23

FOREIGN PATENT DOCUMENTS

| | | |
|---|---|---|
| JP | 2000-225715 | 8/2000 |
| JP | 2004-167736 | 6/2004 |
| JP | 2006-264243 | 10/2006 |
| JP | 2007-015374 | 1/2007 |
| JP | 2007-125775 | 5/2007 |
| JP | 2007-160828 | 6/2007 |
| JP | 2007-160829 | 6/2007 |

* cited by examiner

*Primary Examiner* — An Do
(74) *Attorney, Agent, or Firm* — Workman Nydegger

(57) ABSTRACT

When a predetermined time T1ref has elapsed from performance of a previous cleaning, all nozzles in a nozzle row as an inspection target are driven at a drive frequency of a maximum frequency so that an air bubble in a filter chamber is crushed against a filter by increasing the flow rate in the filter chamber of an ink needle which connects an ink cartridge and a head, and a nozzle inspection to determine whether or not a nozzle defect is occurred is performed repeatedly until the nozzle defect occurs at a predetermined time interval T2ref (every week, for example) and, when the nozzle defect occurs, cleaning for ejecting the air bubble in the filter chamber to the outside is performed.

15 Claims, 11 Drawing Sheets

LIQUID EJECTING APPARATUS AND METHOD OF CONTROLLING SAME

The entire disclosure of Japanese Patent Application Nos. 2007-229301, filed Sep. 4, 2007, 2008-033805, filed Feb. 14, 2008, 2008-203285, filed Aug. 6, 2008 are expressly incorporated by reference herein.

BACKGROUND OF THE INVENTION

The present invention relates to a liquid ejecting apparatus for ejecting liquid to a target and a method of controlling the same.

DESCRIPTION OF THE RELATED ART

In the related art, as a liquid ejecting apparatus, there is proposed the one configured, for example, as an ink jet printing apparatus, which includes a hollow ink supply needle having a distal end portion to be inserted into an ink cartridge and a proximal end portion in communication with an ink flow channel continuing to a head (for example, see Japanese Unexamined Patent Application Publication No. 2007-125775). The ink supply needle described above has an internal channel formed with a filter chamber having a filter arranged therein, so that ink from the ink cartridge is supplied toward the head through this filter. Therefore, an air bubble and other foreign substances contained in the ink cartridge are trapped in the filter chamber by the filter.

The air bubble trapped in the filter chamber grows larger with time, so that they might clog the filter chamber, and cause defective ejection of ink. Therefore, cleaning process for sucking ink in the ink flow channel generally before the air bubble grows larger to allow the air bubble in the filter chamber to pass through the filter is performed. In this case, in order to discharge the air bubble in the filter chamber, a large amount of ink is consumed because ink in the ink flow channel extending from the filter chamber to the head is needed to be sucked almost completely. Therefore, in order to avoid the cleaning process as described above from being performed more than necessary, it is required to adjust the timing of performance adequately.

SUMMARY

It is a principal object of a liquid ejecting apparatus in the present invention and a method of control the same to adjust the timing of performance of head cleaning adequately and restrain the amount of consumption of liquid. In order to achieve the principal object described above, the liquid ejecting apparatus in the present invention and the method of controlling the same are invented as follows.

The liquid ejecting apparatus according to the present invention is an liquid ejecting apparatus that ejects liquid on a target including a head having a liquid storage portion for storing the liquid, a nozzle row that ejects the liquid, and a liquid supply channel that supplies the liquid stored in the liquid storage portion to the nozzle row; a ejecting state inspecting unit that controls the flow rate of the liquid supply channel to achieve an inspection flow rate which is faster than the flow rate in the liquid supply channel when ejecting the liquid to the target at predetermined timing and performs a ejecting state inspection for detecting the ejecting state of the liquid from the nozzle row; and a cleaning performing unit that performs the head cleaning when a defective ejection of the liquid from the nozzle row is detected by the ejecting state inspecting unit and does not perform the head cleaning when the defective ejection of the liquid from the nozzle row is not detected by the ejecting state inspecting unit.

According to the liquid ejecting apparatus in the present invention, the flow rate of the liquid supply channel is adjusted to achieve the inspection flow rate which is faster than the flow rate in the liquid supply channel when ejecting the liquid to the target at predetermined timing and the ejecting state inspection for detecting the ejecting state of the liquid from the nozzle row is performed, and head cleaning is performed when a defective ejection of the liquid from the nozzle row is detected, and the head cleaning is not performed when the defective ejection of the liquid from the nozzle row is not detected. In general, since the amount of consumption of liquid used for detecting the ejecting state of the nozzle row is smaller than the amount of consumption of the liquid used for the cleaning in the liquid supply channel, the frequency of performance of the cleaning is reduced and hence the amount of liquid consumption is restrained as a whole by detecting the ejecting state of the nozzle row to confirm whether there is a defective ejection in the nozzle row or not before performing the head cleaning. Here, the reason why the flow rate in the liquid flow channel is controlled to the inspection flow rate for detecting the ejecting state of the nozzle row which is faster than the flow rate in the liquid supply channel when ejecting the liquid to the target as is because, for example, when air bubble contained in the liquid supply channel is grown to a certain size, they are crushed and deformed more with increase in flow rate in the liquid flow channel, and the deformed air bubble clogs the liquid flow channel and cause the defective ejection, and hence the extent of the growth of the air bubbles in the liquid supply channel is determined by detecting the ejecting state. The "liquid supply channel" is also able to supply the liquid stored in the liquid storage portion to the nozzle row via the filter. The "cleaning performing unit" may be adapted to be a unit that cleans the head so as to allow the air bubble in the liquid supply channel to be discharged from the nozzle row. The liquid ejecting apparatus according to the present invention includes the one which forms dots on the target by ejecting the liquid on the target.

In the liquid ejecting apparatus in the present invention, the ejecting state inspecting unit may be adapted to control the flow rate in the liquid supply channel at the inspection flow rate during a period in which an air bubble having a predetermined size clogs the interior of the liquid supply channel to perform the ejecting state inspection. In this configuration, the ejecting state of the liquid is inspected with high degree of accuracy.

In the liquid ejecting apparatus in the present invention, the ejecting state inspecting unit may be adapted to drive and control the head at a drive frequency in a frequency range higher than the case of ejecting the liquid to the target to perform the ejecting state inspection. In this configuration, the flow rate in the liquid supply channel is adjusted to the inspection flow rate with higher degree of reliability.

In the liquid ejecting apparatus in the present invention, the ejecting state inspecting unit may be adapted to drive and control the head to eject the liquid from approximately 100% of the nozzle row to perform the ejecting state inspection. In this configuration, the flow rate in the liquid supply channel is adjusted to the inspection flow rate with higher degree of reliability.

In the liquid ejecting apparatus in the present invention, the ejecting state inspecting unit may be adapted to be a unit that drives and controls the head so as to eject the liquid from the nozzle row at a higher rate than the case of ejecting the liquid to the target. In this configuration, the flow rate in the liquid supply channel is adjusted to the inspection flow rate with higher degree of reliability. In this case, a drive voltage to be applied to the head may be higher than that for ejecting the liquid to the target.

In the liquid ejecting apparatus in the present invention, the ejecting state inspecting unit may be adapted to be a unit that controls the flow rate in the liquid supply channel to be the inspection flow rate by pressurizing the liquid from the upstream side of the liquid supply channel. In this configuration, the flow rate in the liquid supply channel is adjusted to the inspection flow rate with higher degree of reliability.

In the liquid ejecting apparatus in the present invention, the ejecting state inspecting unit may be adapted to be a unit that controls the flow rate in the liquid supply channel to be the inspection flow rate by sealing ejection ports of the nozzle row and depressurizing the same. In this configuration, the flow rate in the liquid supply channel is adjusted to the inspection flow rate with higher degree of reliability.

In the liquid ejecting apparatus in the present invention, the ejecting state inspecting unit may be adapted to be a unit that performs the ejecting state inspection when a first predetermined period has elapsed from the performance of the previous cleaning by the cleaning performing unit as the predetermined timing and, when the defective ejection is not detected by the inspection, performs the ejecting state inspection every time when a second predetermined period, which is shorter than the first predetermined period, has elapsed until the defective ejection is detected. In this case, the first predetermined period may be set on the basis of the growing speed of the air bubble under the conditions that the air bubble in the liquid supply channel grows most rapidly. In this configuration, the growth of the air bubble in the liquid supply channel is restrained before growing to a size which clogs the liquid supply channel irrespective of the conditions under which the liquid ejecting apparatus is used.

The liquid ejecting apparatus in the present invention may include a second ejecting state inspecting unit that controls the flow rate of the liquid supply channel so as to be a second inspection flow rate slower than the inspection flow rate at a timing different from the predetermined timing, and a second cleaning performing unit that performs the head cleaning in association with consumption of the liquid of an amount smaller than that by the cleaning performing unit when the defective ejection of the liquid from the nozzle row is detected by the second ejecting state inspecting unit and does not perform the head cleaning when the defective ejection of the liquid from the nozzle row is not detected by the ejecting state inspecting unit. In this configuration, the cleaning of a portion near the ejection ports of the nozzle row and in the interior of the liquid supply channel are achieved respectively at an effective timing.

In the liquid ejecting apparatus in the present invention, the head may include a plurality of liquid storage portions for storing liquid in various colors, a plurality of nozzle rows that eject various colors of liquid, and a plurality of liquid flow channels that supply liquid stored in the plurality of liquid storage portions to the corresponding nozzle rows, the ejecting state inspecting unit may be a unit that performs the ejecting state inspection for the plurality of nozzle rows at timings different from each other, and the cleaning performing unit may be a unit that performs the cleaning for the nozzle row at which the defective ejection is detected by the ejecting state inspecting unit. In this configuration, performance of the ejecting state inspection is prevented from being continued for a long time.

Alternatively, in the liquid ejecting apparatus in the present invention, the head may include a plurality of liquid storage portions for storing liquid in various colors, a plurality of nozzle rows that eject various colors of liquid, and a plurality of liquid flow channels that supply liquid stored in the plurality of liquid storage portions to the corresponding nozzle rows, the ejecting state inspecting unit may be a unit that detects the liquid ejecting state from a predetermined nozzle row from among the plurality of nozzle rows, and the cleaning performing unit may be a unit that performs the cleaning for all the plurality of nozzle rows when the defective ejection is detected at the predetermined nozzle row by the ejecting state inspecting unit. In this configuration, it is not necessary to perform the ejecting state inspection for all the plurality of nozzle rows, and hence the amount of consumption of liquid used for the ejecting state inspection is further reduced. In this manner, performance of the cleaning for all the plurality of nozzle rows on the basis of the ejecting state inspection only for the predetermined nozzle row is based on such determination that the speed of growth of the air bubble in the liquid supply channel is not much different among the respective colors. In the liquid ejecting apparatus in the present invention of this mode, the ejecting state inspecting unit may be a unit that performs the ejecting state inspection using the nozzle row having the largest amount of remaining liquid stored in the corresponding liquid storage portion from among the plurality of nozzle rows as the predetermined nozzle row. In this configuration, fluctuations in remaining amount of liquid among the plurality of liquid storage portions are restrained.

The liquid ejecting apparatus in the present invention may include a liquid receiving unit that receives liquid ejected from the nozzle row when the head is located at a predetermined position; a potential difference providing unit that provides a potential difference between the liquid receiving unit and the head; and an electrical change detecting unit that detects a change in the electrical state of the liquid receiving unit or the head, and the ejecting state inspecting unit may be a unit that controls the potential difference providing unit so as to provide the potential difference between the liquid receiving unit and the head, drives and controls the head so that the liquid is ejected from the nozzle row in a state in which the potential difference is provided and detects the ejecting state of the nozzle row on the basis of the change in electrical state of the liquid receiving unit or the head detected by the electrical change detecting unit. The extent of the change in electrical state of the liquid receiving unit or the head is increased and decreased according to the amount of liquid ejected from the nozzle row, and hence the ejecting state inspection is performed easily in comparison with the apparatus which detects the ejecting state by ejecting liquid from the nozzles of the nozzle row one by one.

A method of controlling the liquid ejecting apparatus according to the present invention is a method of controlling the liquid ejecting apparatus having a head having a liquid storage portion for storing liquid, a nozzle row that ejects the liquid, and a liquid supply channel that supplies the liquid stored in the liquid storage portion to the nozzle row and ejecting liquid on a target including; (a) controlling the flow rate of the liquid supply channel to achieve an inspection flow rate which is faster than the flow rate in the liquid supply channel when ejecting the liquid to the target at predetermined timing and performing a ejecting state inspection for detecting the ejecting state of the liquid from the nozzle row; and (b) performing head cleaning when a defective ejection of the liquid from the nozzle row is detected by the step (a) and not performing the head cleaning when the defective ejection of the liquid from the nozzle row is not detected by the ejecting state inspecting unit.

According to the method of controlling the liquid ejecting apparatus in the present invention, the flow rate of the liquid supply channel is controlled to achieve an inspection flow rate which is faster than the flow rate in the liquid supply channel when ejecting the liquid to the target at predetermined timing and the ejecting state inspection for detecting the ejecting state of the liquid from the nozzle row is performed, and head cleaning is performed when a defective ejection of the liquid from the nozzle row is detected, and the head cleaning is not performed when the defective ejection of the liquid from the nozzle row is not detected. In general, since the amount of consumption of liquid used for detecting the ejecting state of the nozzle row is smaller than the amount of consumption of the liquid used for the cleaning in the liquid supply channel, the frequency of performance of the cleaning is reduced and hence the amount of liquid consumption is restrained as a whole by detecting the ejecting state of the nozzle row to confirm whether there is a defective ejection in the nozzle row or not before performing the head cleaning. Here, the reason why the flow rate in the liquid flow channel is controlled to the inspection flow rate for detecting the ejecting state of the nozzle row which is faster than the flow rate in the liquid supply channel for ejecting the liquid to the target as is because, for example, when the air bubble contained in the liquid supply channel is grown to a certain size, they are crushed and deformed more with increase in flow rate in the liquid flow channel, and the deformed air bubble clogs the liquid flow channel and cause the defective ejection, and hence the extent of the growth of the air bubbles in the liquid supply channel is determined by detecting the ejecting state. The "liquid supply channel" is also able to supply liquid store in the liquid storage portion to the nozzle row via the filter.

The "step (b)" may be adapted to be a step of cleaning the head so as to allow the air bubble in the liquid supply channel to be ejected from the nozzle row.

DESCRIPTION OF THE PREFERRED EMBODIMENTS

Figure 1:
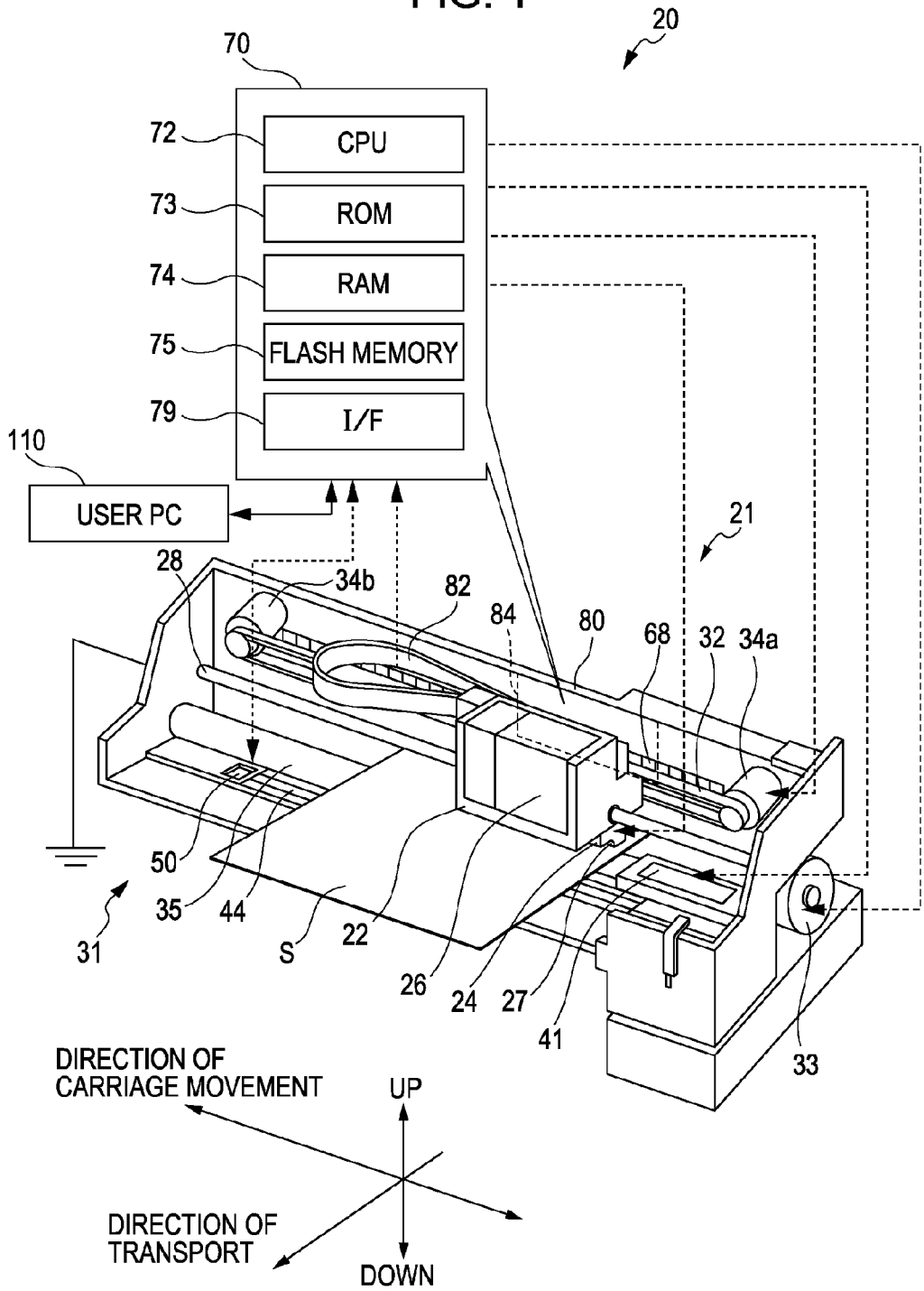
FIG. 1 is a configuration drawing showing a configuration of an ink jet printer 20 in this embodiment schematically.
Figure 2:
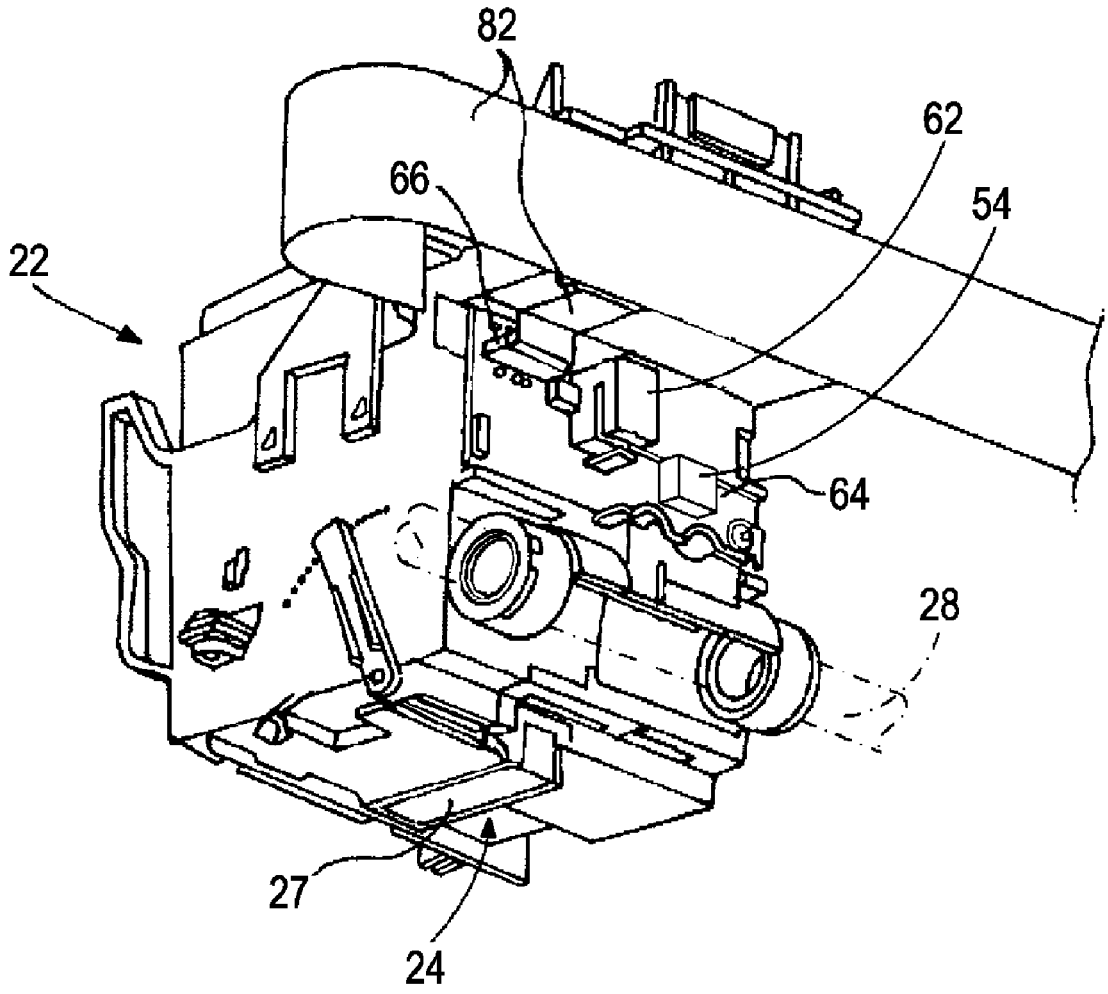
FIG. 2 is a perspective view of a carriage 22 from the lower back side.
Figure 3:
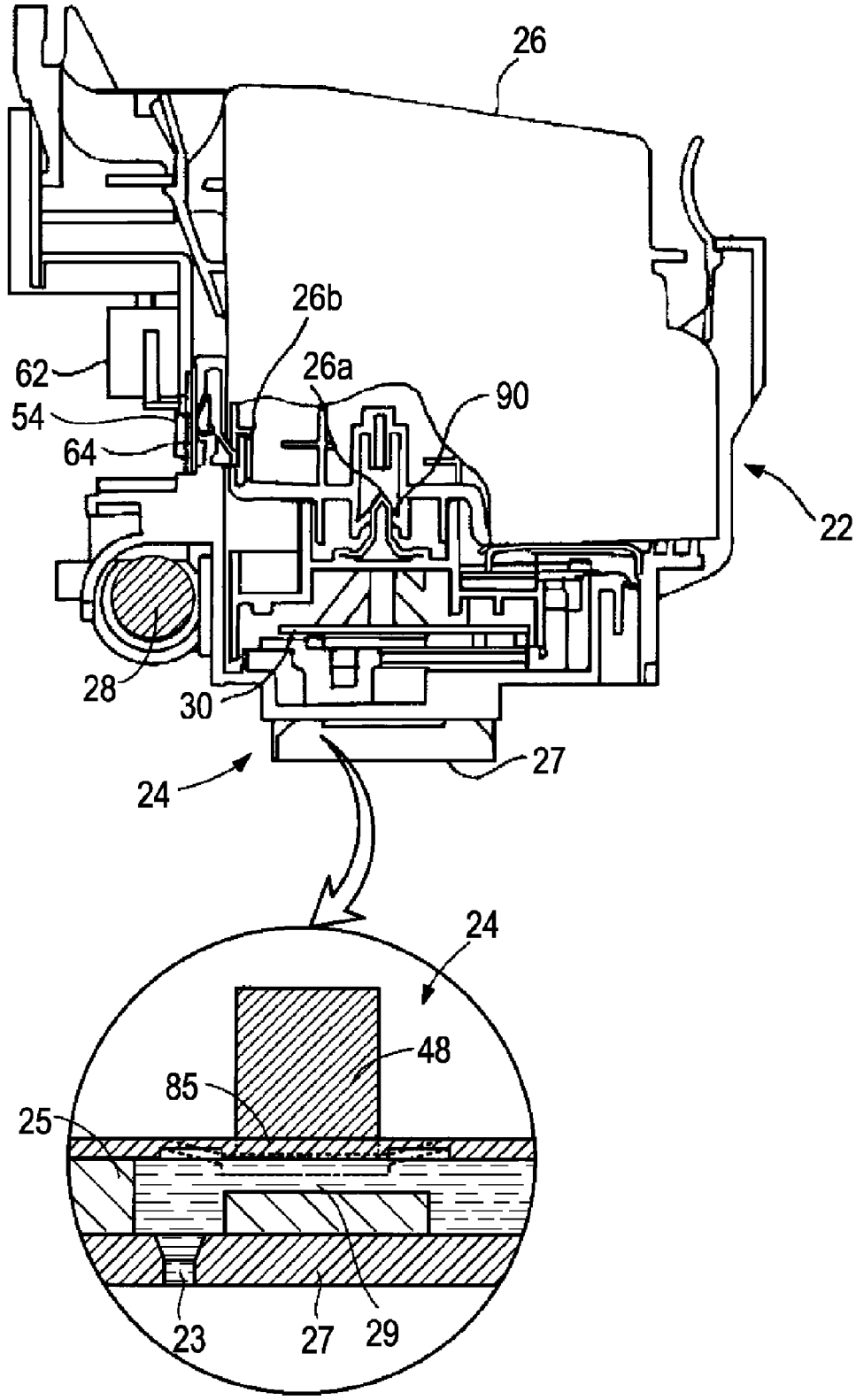
FIG. 3 is a left side view of the carriage 22 (exploded cross-sectional view and a portion in a circle is a partially enlarged cross-sectional view).
Figure 4:
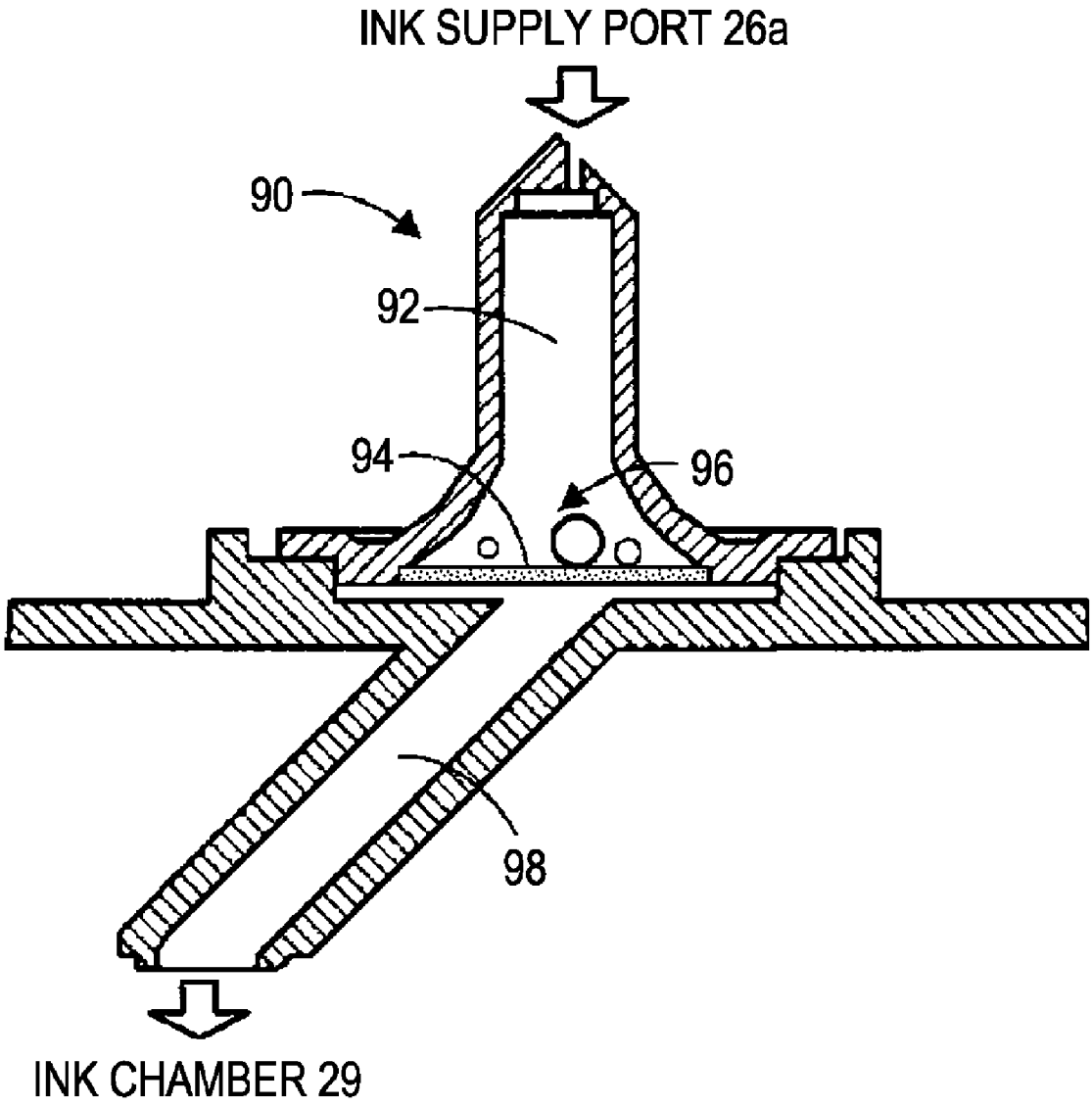
FIG. 4 is a cross-sectional configuration drawing showing a cross-sectional configuration of an ink supply needle 90.
Figure 5:
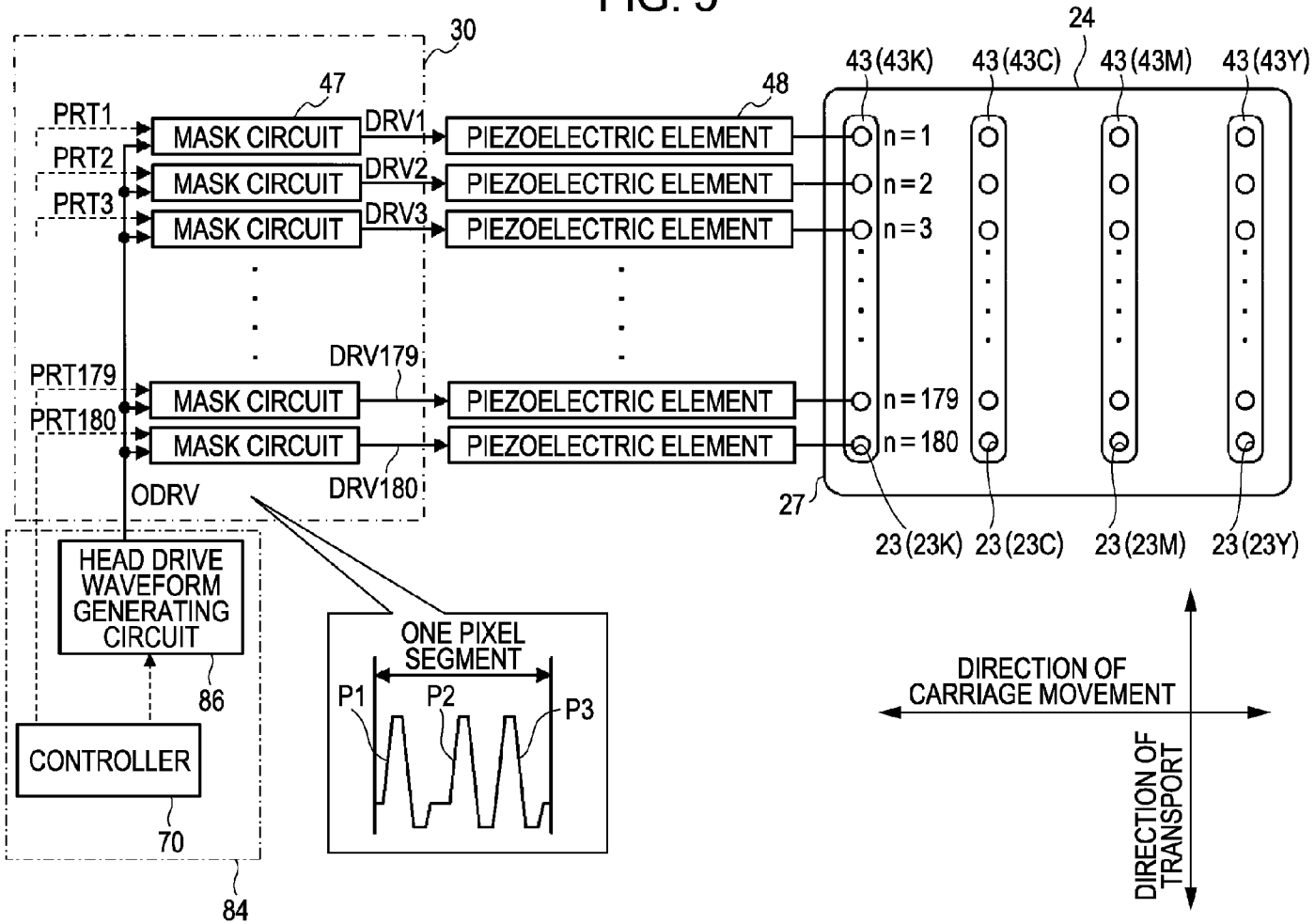
FIG. 5 is an explanatory drawing showing an electrical connection of a printhead 24.
Figure 6:
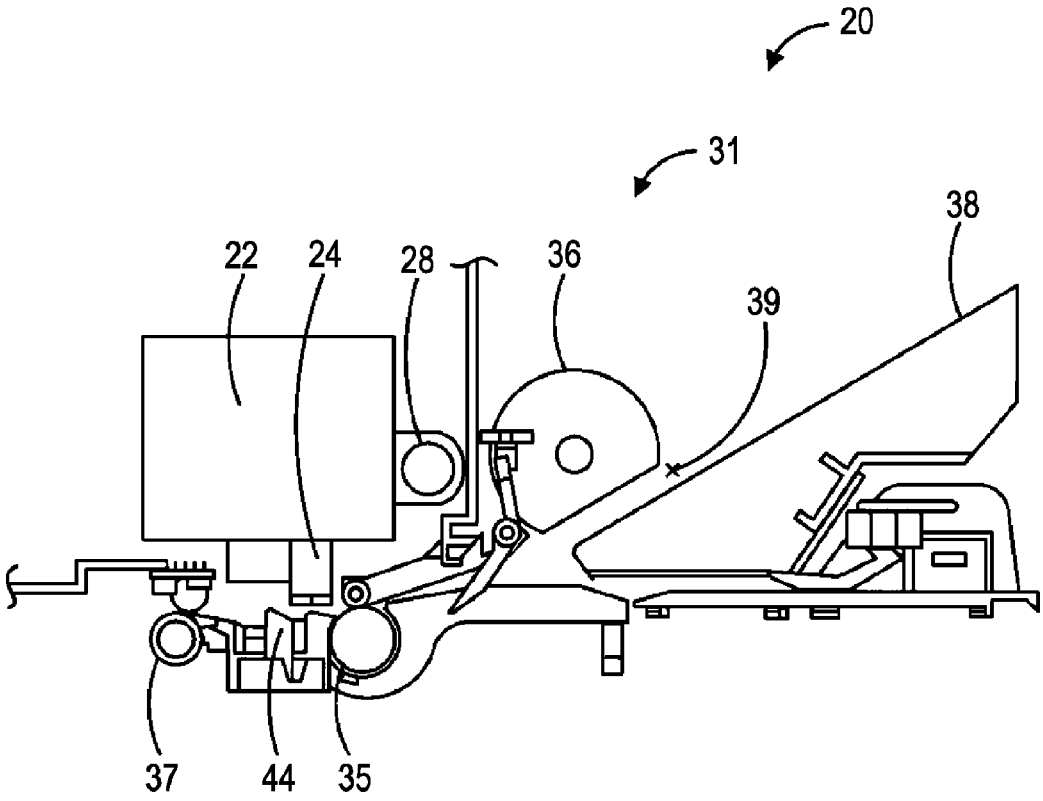
FIG. 6 is an explanatory drawing of a paper feed mechanism 31.
Figure 7:
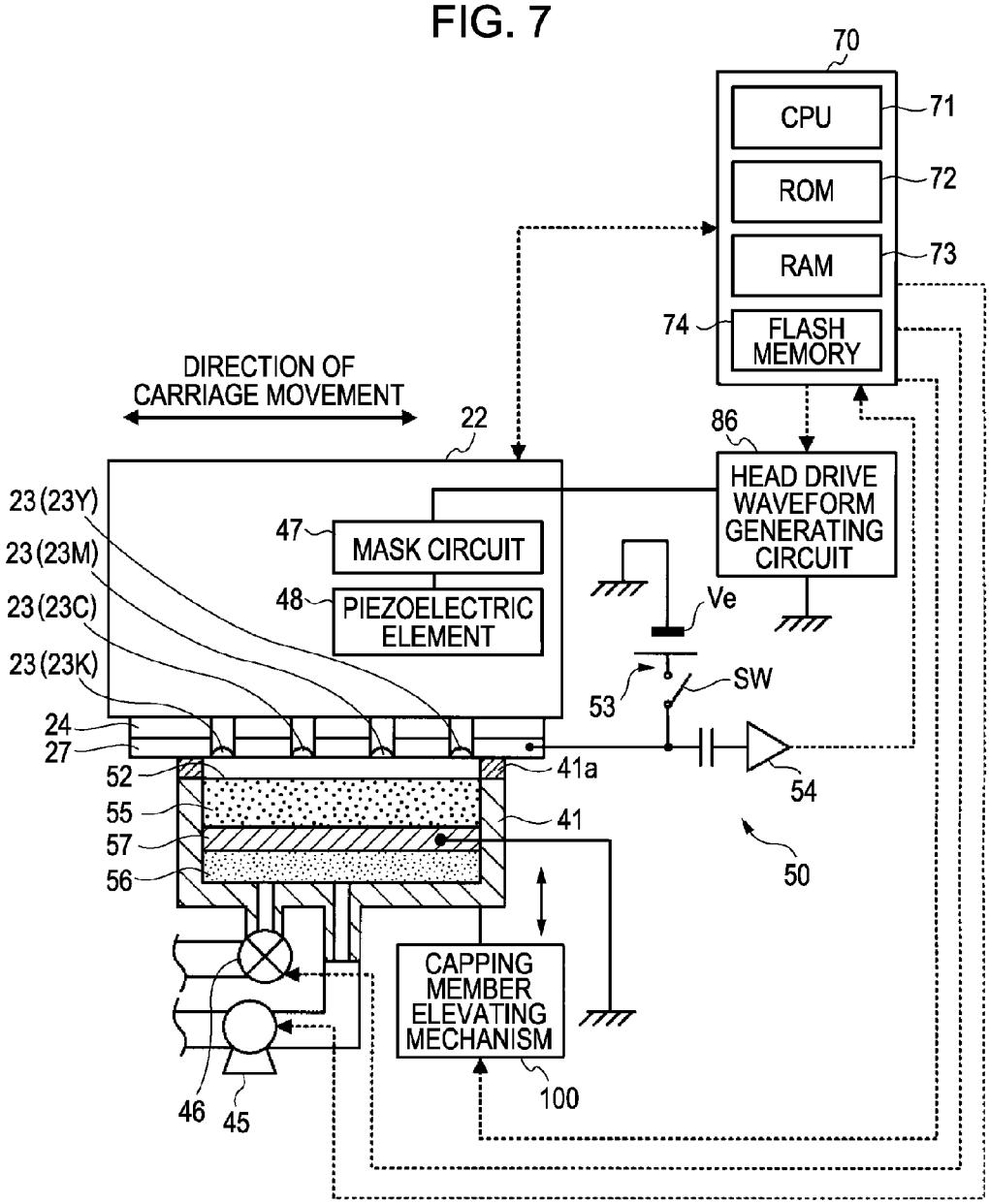
FIG. 7 is a configuration drawing schematically showing a configuration of a nozzle inspection apparatus 50.

An embodiment in which the present invention is embodied will be described. FIG. 1 is a configuration drawing showing a configuration of an ink jet printer 20 in this embodiment schematically, FIG. 2 is a perspective view of a carriage 22 from the lower back side, FIG. 3 is a left side view of the carriage 22 (exploded cross-sectional view and a portion in a circle is a partially enlarged cross-sectional view), FIG. 4 is a cross-sectional configuration drawing showing a cross-sectional configuration of an ink supply needle 90, FIG. 5 is an explanatory drawing showing an electrical connection of a printhead 24, FIG. 6 is an explanatory drawing of a paper feed mechanism 31, and FIG. 7 is a configuration drawing schematically showing a configuration of a nozzle inspection apparatus 50.

As shown in FIG. 1, the ink jet printer 20 in this embodiment includes a printer mechanism 21 that ejects ink drops on a printing sheet S transported from the far side toward the near side on a platen 44 for performing a printing job, the paper feed mechanism 31 having a paper feed roller 35 driven by a drive motor 33, a capping member 41 formed near a right end of the platen 44, the nozzle inspection apparatus 50 that inspects whether or not the ink drops are normally ejected from a nozzle plate 27 of the printhead 24 in a state in which the printhead 24 is sealed by the capping member 41 (see FIG. 7), a suction pump 45 that sucks ink in the printhead 24 in a state in which the printhead 24 is sealed by the capping member 41 (see FIG. 7), and a controller 70 that controls the entire ink jet printer 20.

The printer mechanism 21 includes the carriage 22 which reciprocates to the left and right along a guide 28 by a carriage belt 32, an ink cartridge 26 that is mounted on the carriage 22 and stores ink in yellow (Y), magenta (M), cyan (C) and black (K) separately, and the printhead 24 that ejects ink in respective colors supplied from the ink cartridge 26 from the nozzle plate 27.

The carriage 22 moves in association with the carriage belt 32 extending between a carriage motor **34*a* attached to the right side of a mechanical frame 80 and a driven roller 34*b* attached to the left side of the mechanical frame 80 and being driven by the carriage motor 34*a*. As shown in FIG. 2, an encoder substrate 64 having a photo detector 62 mounted thereon is attached to the back surface of the carriage 22. The photo detector 62 transmits signals with the controller 70 on a main substrate 84 (see FIG. 1) attached to the back surface of the mechanical frame 80 via a flat cable 82 inserted into a connector unit 66 which is a bundle of wires on the encoder substrate 64. The photo detector 62 outputs a position signal acquired by optically reading scales on a linear scale 68 extending on the mechanical frame 80 to make the carriage belt 32 extend in parallel to the controller 70. The controller 70 then recognizes where in the direction of movement of the carriage (primary scanning direction) the carriage 22 is located on the basis of this position signal. The photo detector 62 and the linear scale 68** constitute a linear encoder.

Although not shown, the ink cartridge 26 is configured as a container for storing various colors of ink as printing liquid used for the printing in cyan (C), magenta (M) yellow (Y), black (K) containing dye staff or pigment as coloring agent in water as solvent, and is detachably attached to the carriage 22. The ink cartridge 26 includes an ink supply port **26*a* for each color of ink as shown in FIG. 3, and is enabled to supply ink to the printhead 24 formed on a lower surface of the carriage 22 when the ink supply needle 90 provided on the carriage 22 is inserted into the ink supply port 26*a*. An integrated circuit substrate 26*b* which stores data such as the amount of remaining ink or the like is attached to a side surface of the ink cartridge 26, and the integrated circuit substrate 26*b* is electrically connected to the encoder substrate 64 via a connecting terminal, not shown, and transmits signals with respect to the controller 70 on the main substrate 84 via the encoder substrate 64**.

As shown in FIG. 3, the printhead 24 includes the nozzle plate 27 formed of stainless steel formed with a plurality of nozzles 23, a cavity plate 25 formed with ink chambers 29 which communicate with the nozzles 23 formed on the nozzle plate 27, a piezoelectric element 48 adhered to a diaphragm 85 formed of ceramic (for example, formed of zirconia ceramic) which serves as an upper wall of the ink chamber 29, and a head driving substrate 30 provided with a mask circuit 47 (see FIG. 4) or the like which drives the piezoelectric element 48. Ink is supplied from the ink supply port 26*a* of the ink cartridge 26 via the ink supply needle 90.

The ink supply needle 90 is configured as a hollow member having an internal channel 92 which is connected at the distal end thereof to the ink supply port 26*a* of the ink cartridge 26, and at the proximal end to the ink flow channel 98 which communicates with the ink chamber 29. The ink supply needle 90 is formed with a filter chamber 96 having a filter 94 attached thereto in the proximal portion thereof, so that ink from the ink cartridge 26 (ink supply port 26*a*) is supplied to the ink chamber 29 via the filter 94. In this case, the air bubble and foreign substances contained in the ink are trapped by the filter 94, and are accumulated in the filter chamber 96. The filter chamber 96 is formed as an internal space of a substantially conical shape which increases in diameter toward the proximal end so that the air bubble and the foreign substances trapped by the filter 94 are sufficiently accumulated. As the filter 94, a fabric obtained by twilling fibers of metal or synthetic resin, a non-woven fabric obtained by sintering metal fibers, or a plate member obtained by forming minute holes in a metal foil by etching or the like is used.

The nozzle plate 27 includes, as shown in FIG. 5, nozzle rows 43 each having a plurality of nozzles 23 for ejecting respective colors of ink; cyan (C), magenta (M), yellow (Y), and black (K) are provided. Here, all the nozzles are generally referred to as nozzles 23, all the nozzle rows as nozzle rows 43, the nozzles and nozzle row of cyan as nozzles 23C and nozzle row 43C, the nozzles and nozzle row of magenta as nozzles 23M and nozzle row 43M, the nozzles and nozzle row of yellow as nozzles 23Y and nozzle row 43Y, and the nozzles and nozzle row of black as nozzles 23K and nozzle row 43K. Hereinafter, a description is given using the nozzles 23K. In this printhead 24, 180 nozzles 23K are arranged along the direction of transport of the printing sheet S to constitute the nozzle row 43K. Each nozzle 23K includes a piezoelectric element 48 as a drive element for ejecting ink drops, and the piezoelectric element 48 is deformed by applying a voltage to the piezoelectric element 48 so that ink is pressurized and is ejected from the nozzle 23K. In a circle in FIG. 3, the piezoelectric element 48 before deformation is indicated by a solid line, and the piezoelectric element 48 after deformation is indicated by a dotted line. As shown in this drawing, the piezoelectric element 48 after deformation pressurizes ink by pressing the upper wall of the ink chamber 29 downward.

The head driving substrate 30 includes the mask circuit 47 for applying a voltage to the piezoelectric element 48 mounted thereon as shown in FIG. 5. The head driving substrate 30 is connected to the flat cable 82 (see FIG. 1) via a connector unit, not shown, for transmitting signals with the controller 70 on the main substrate 84 via the flat cable 82. The mask circuit 47 is provided for each of the piezoelectric element 48 which drives the each nozzle 23K. A raw signal ODRV or a print signal PRTn generated in a head drive waveform generating circuit 86 on the main substrate 84 are entered to the mask circuit 47. The sign n at the end of the print signal PRTn is the number for specifying the nozzle included in the nozzle row. Since the nozzle row in this embodiment includes 180 nozzles, the sign n designates an integer from 1 to 180. The raw signal ODRV includes a first pulse P1, a second pulse P2 and a third pulse P3 in a one pixel segment (within a period during which the carriage 22 traverse the interval of one pixel) as shown in FIG. 5. The raw signal ODRV having these three pulses P1 to P3 as a unit of repetition is referred to as one pixel segment in this embodiment. When the raw signal ODRV or the print signal PRTn are entered, the mask circuit 47 outputs required pulse from among the first pulse P1, the second pulse P2, and the third pulse P3 as a drive signal DRVn (the meaning of the sign n is the same as that of the print signal PRTn) to the piezoelectric element 48 on the basis of the entered signal. More specifically, when only the first pulse P1 is outputted from the mask circuit 47 to the piezoelectric element 48, one shot of ink drop is ejected from the nozzle 23K, so that a dot of a small size (small dot) is formed on the printing sheet S. When the first pulse P1 and the second pulse P2 are outputted to the piezoelectric element 48, two shots of ink drops are ejected from the nozzle 23K and a dot of a middle size (middle dot) is formed on the printing sheet S. When the first pulse P1, the second pulse P2, and the third pulse P3 are outputted to the piezoelectric element 48, three shots of ink drops are discharged from the nozzles 23K, and a dot of a large size (large dot) is formed on the printing sheet S. In this manner, the ink jet printer 20 is able to form three sizes of dots by adjusting the amount of ink to be ejected in the one pixel segment. Other nozzles 23C, 23M, 23Y or nozzle rows 43C, 43M and 43Y are also the same as the nozzles 23K and the nozzle row 43K. The printhead 24 employs here a system of pressurizing ink by deforming the piezoelectric element 48. However, a system of applying a voltage to a heat-generating member (heater, for example) to heat the ink and pressurizing ink by air bubble generated thereby may be employed.

As shown in FIG. 6, the paper feed mechanism 31 includes a recording paper insertion port 39 for inserting the printing sheet S placed on a paper delivery tray 38, a paper delivery roller 36 for feeding the printing sheet S placed on the paper delivery tray 38 to the printhead 24, the paper feed roller 35 for carrying the printing sheet S or a roll paper to the printhead 24, and a paper discharge roller 37 for ejecting the printing sheet S after printing. The paper delivery roller 36, the paper feed roller 35, and the paper discharge roller 37 are driven by the drive motor 33 (see FIG. 1) via a gear mechanism, not shown. The rotational drive force of the paper delivery roller 36 and the frictional resistance of a separation pad, not shown, prevent a plurality of the printing sheets S from being fed at once. In FIG. 1, the direction of transport of the printing sheet S is from the far side toward the near side, and the direction of movement of the carriage 22 which moves together with the printhead 24 is a direction orthogonal to the direction of transport of the printing sheet S (principal scanning direction).

The capping member 41 is a casing provided at a position deviated to the right from a printable area of the platen 44 in FIG. 1 and having a substantially rectangular parallelepiped shape opening on top, and a sealing member 41*a* formed of an insulating material such as silicon rubber is formed at an opening edge. The capping member 41 is used not only for sealing the nozzles 23 to prevent the nozzles 23 from drying while the printing job is halted, and also for cleaning the printhead 24 when inspecting the presence or absence of nozzle clogging. The suction pump 45 and an air release valve 46 are connected separately to the capping member 41, and when cleaning the printhead 24, the air release valve 46 is opened in a state of sealing the nozzles 23 and the suction pump 45 is activated to generate a negative pressure in the internal space of the capping member 41, whereby the ink in the nozzles 23 is forcedly sucked. The cleaning of the printhead 24 includes cleaning for solving or preventing clogging of the openings of the nozzles 23 by sucking a relatively small amount (for example, 0.1 g or 0.2 g) of ink and cleaning for solving or preventing clogging of the internal channel 92 by the air bubble in the filter chamber 96 by causing the air bubble trapped in the filter chamber 96 of the ink supply needle 90 to pass through the filter 94 and to be discharged outside by sucking a relatively large amount (for example, 2 g, 3 g, or 4 g) of ink. Release of sealing of the nozzles 23 by the capping member 41 is achieved by stopping the suction pump 45 and opening the air release valve 46. An elastic tube is connected to the suction pump 45 and the air release valve 46. Arranged in the interior of the capping member 41 are an upper ink absorber 55 to which the ink drops directly land, a lower ink absorber 56 for absorbing the ink drops transmitted downward after having landed on the upper ink absorber 55, and a mesh-type electrode member 57 arranged between the upper ink absorber 55 and the lower ink absorber 56. The upper ink absorber 55 is formed of electrically conductive sponge to achieve the substantially same potential as the electrode member 57, and the surface thereof corresponds to an inspection area 52. The sponge has a high transmissibility which allows quick downward movement of landed ink drops, and here, an ester-based urethane sponge (name of the commodity; Ever Light SK-E, Bridgestone Corporation) is employed. When the carriage 22 is moved to the rightmost position of the guide 28 in FIG. 1 (home position), a capping member elevating mechanism 100 is activated and the capping member 41 comes into abutment with the nozzle plate 27 via the sealing member 41*a*. In this case, the upper ink absorber 55 opposes the nozzle plate 27 with a slight gap therebetween. The lower ink absorber 56 has a higher ink holding performance in comparison with the upper ink absorber 55, and is formed of a non-woven fabric such as a felt. Here, a non-woven fabric (name of commodity; KINOCLOTH, OJI KINOCLOTH Co., Ltd.) is employed. The electrode member 57 is formed into a gridiron mesh formed of metal of stainless steel (for example, SUS). Therefore, the ink absorbed in the upper ink absorber 55 once passes through the gap of the gridiron electrode member 57 and is absorbed and held in the lower ink absorber 56. The electrode member 57 is grounded via the mechanical frame 80 (see FIG. 1). Here, the electrode member 57 comes into contact with the upper ink absorber 55 having an electrical conductivity, and hence the surface of the upper ink absorber 55, that is, the inspection area 52 is also grounded like the electrode member 57.

The nozzle inspection apparatus 50 includes a voltage application circuit 53 and a voltage detection circuit 54 in this embodiment as shown in FIG. 7. The voltage application circuit 53 is a circuit for boosting the voltage of the electric wiring of a several volts lead in the ink jet printer 20 to a several tens to several hundreds of volts via a boosting circuit, not shown, and applying a DC voltage Ve after having boosted to the nozzle plate 27 of the printhead 24 via a switch SW. The voltage detection circuit 54 is connected so as to detect a voltage change in the nozzle plate 27, and is adapted to A/D covert a signal after having integrated with a voltage signal of the nozzle plate 27 and inverted and amplified and output to the controller 70. The voltage detection circuit 54 and the boosting circuit, not shown, are mounted on the head driving substrate 30.

The controller 70 is provided on the main substrate 84 attached to the back surface of the mechanical frame 80 as shown in FIG. 1, and is configured as a microprocessor having a CPU 72 as a main component, and includes a ROM 73 in which various processing programs are stored and a RAM 74 for storing data temporarily or saving the data, a flash memory 75 which is data writable and erasable, an interface (I/F) 79 for transmitting data with external apparatuses, and an I/O port, not shown. The ROM 73 stores various processing programs such as a main routine or a nozzle inspection routine, described later. The RAM 74 includes a print buffer area, and print data sent from an user PC 110 to the print buffer area via the I/F 79 are stored therein. The controller 70 receives a voltage signal outputted from the voltage detection circuit 54 of the nozzle inspection apparatus 50 or a position signal of the carriage 22 from the photo detector 62 entered via the input port, not shown, and receives a printing jot or the like outputted from the user PC 110 via the I/F 79. Control signals to the printhead 24 (including the mask circuit 47 or the piezoelectric element 48), switch signals to the switch SW, control signals to the head drive waveform generating circuit 86, control signals to the drive motor 33, drive signals to the carriage motor 34*a* are outputted from the controller 70 via the output port, not shown, and print status data to the user PC 110 is outputted therefrom via the I/F 79.

Figure 8:
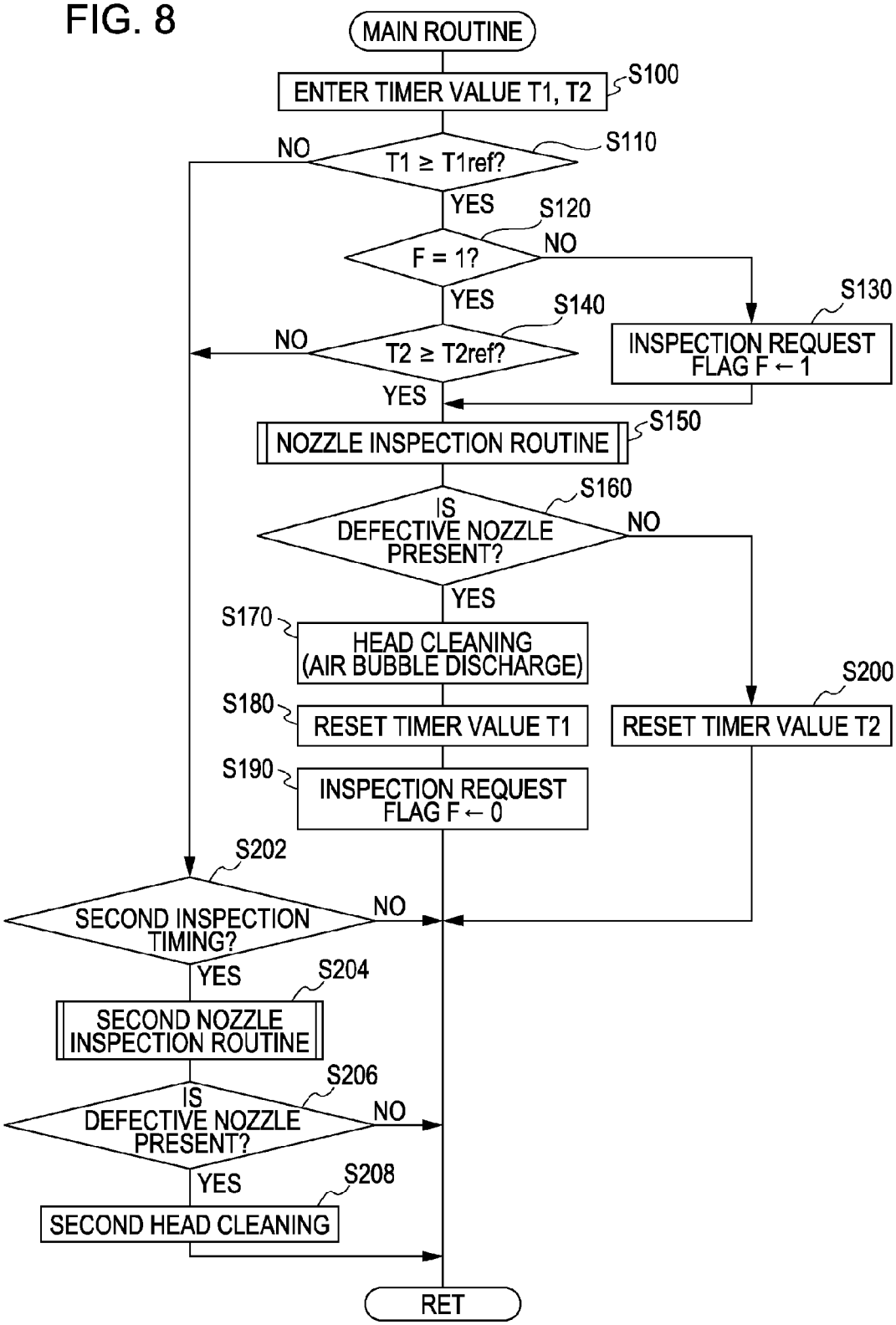
FIG. 8 is a flowchart of a main routine.

Subsequently, the operation of the ink jet printer 20 in the embodiment configured in this manner, more specifically, the operation to discharge the air bubble accumulated in the filter chamber 96 of the ink supply needle 90 will be described. FIG. 8 is a flowchart of a main routine executed by the CPU 72 of the controller 70. The main routine is repeatedly executed at every predetermined time interval after the power source of the ink jet printer 20 is turned ON (for example, at every several msecs or several tens msecs).

When the main routine is executed, the CPU 72 inputs timer values T1, T2 (Step S100), and determines whether the entered timer value T1 exceeds a threshold value T1ref or not (Step S110). The timer value T1 here is a timer reset to the value 0 when the cleaning of the printhead 24, described later, is performed. The timer value T2 will be described later. The threshold value T1ref in this embodiment specifies the timing to perform the nozzle inspection, described later, and is set to, for example, one month or the like. When the timer value T1 is smaller than the threshold value T1ref, it is determined that the degree of growth of the air bubble in the filter chamber 96 is small, and the routine is ended without doing any process.

Figure 9:
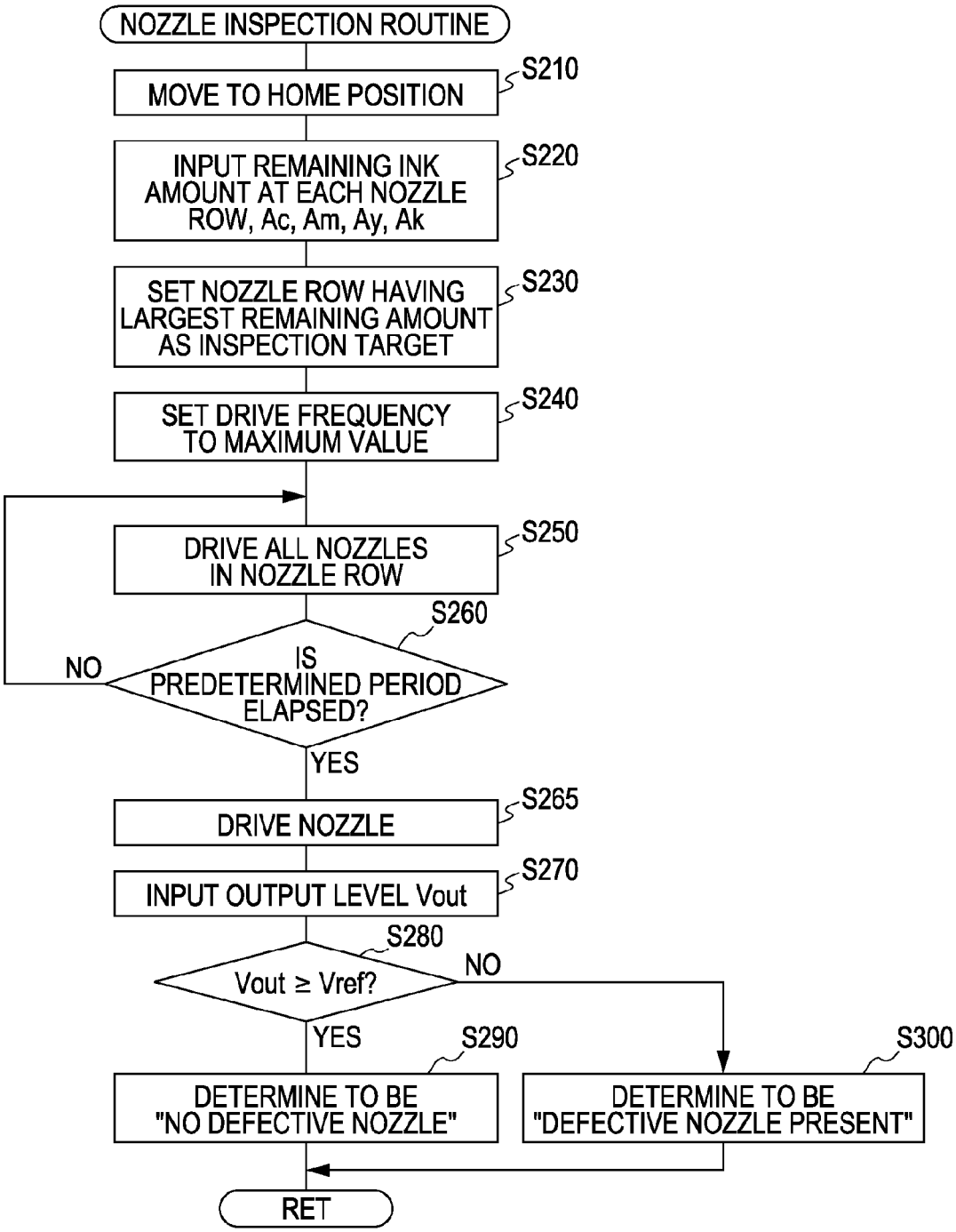
FIG. 9 is a flowchart of a nozzle inspection routine.
Figure 10:
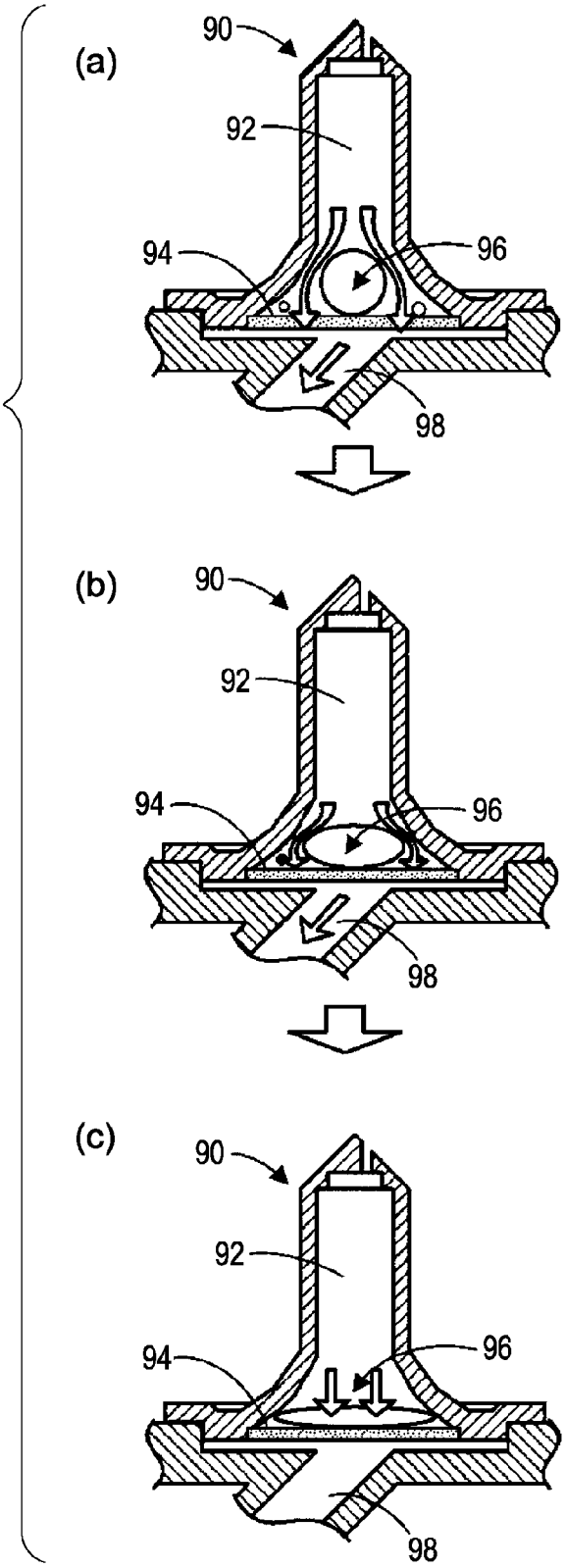
FIG. 10 is an explanatory drawing showing a state of deformation of air bubble.

In contrast, when the timer value T1 is threshold value T1ref or larger, an inspection request flag F is inspected (Step S120) and, when the inspection request flag F is a value 0, a value 1 is set to the inspection request flag F (Step S130), and the nozzle inspection routine is performed (Step S150). Here, the description of the main routine in FIG. 8 is disconnected, and detailed description of the nozzle inspection routine is given below. FIG. 9 is a flowchart showing an example of the nozzle inspection routine performed by the controller 70. When the nozzle inspection routine is performed, the CPU 72 of the controller 70 firstly drives the carriage motor 34*a* to move the carriage 22 to the home position (Step S210). When the carriage 22 is moved to the home position, the capping member elevating mechanism 100 is activated to move the capping member 41 upward, so that the capping member 41 is brought into contact with the nozzle plate 27 of the printhead 24 via the sealing member 41*a*. At this time, the nozzle plate 27 and the inspection area 52 in the capping member 41 are brought into an opposed state at proximity of about several millimeters. Subsequently, a remaining ink amount Ac, Am, Ay, Ak in the ink cartridges 26 corresponding to the respective nozzle rows 43 are entered (Step S220), and the nozzle row 43 corresponding to the ink cartridge 26 having the largest remaining amount of ink from among the entered remaining ink amount Ac, Am, Ay, Ak is specified as an inspection target (Step S230), the drive frequency is set to a maximum frequency (Step S240), and the raw signal ODRV is generated at the preset drive frequency, a drive signal DRVn of three pulses of the first pulse P1, the second pulse P2, and the third pulse P3 is outputted to the piezoelectric element 48, and a process of outputting the print signal PRTn for ejecting three shots (maximum number of shots) of ink drops per raw signal ODRV from all the nozzles 23 of the nozzle row 43 as the inspection target is performed for a predetermined time period (Step S250, S260). During the printing job, the raw signals ODRV are generated so as to match the positions of the pixels in accordance with the movement of the carriage 22 in the primary scanning direction, and hence the interval to generate the raw signals ODRV is limited by the speed of movement of the carriage 22 or the printing resolution, whereby a certain interval is to be secured. On the other hand, in the nozzle inspection routine, the interval is not limited by the speed of movement of the carriage 22 or the print resolution, so that the interval is set to a minimum possible value in terms of the limitation of the circuit of the head drive waveform generating circuit 86 generating the row signal ODRV or the ejecting property of the printhead 24. In other words, the frequency of generation of the raw signals ODRV is set to a maximum possible frequency. Accordingly, a large number of ink drops are ejected from all the nozzles 23 of the nozzle row 43 in a short time. Since the print signal PRTn is outputted so as to allow the three drive signals DRVn of the first pulse P1, the second pulse P2, and the third pulse P3 to be outputted to the piezoelectric element 48, the maximum shot number of ink drops per raw signal ODRV are achieved, whereby ejection of a large number of ink drops from all the nozzles 23 of the nozzle row 43 is achieved in a short time. The above-described maximum frequency is used in the meaning of the former. However, it may be used in the meaning of maximizing the number of shot of the ink drops per raw signal ODRV by using all the pulses for ejecting the ink drops included in the row signal ODRV. In this case, the interval of generation of the raw signals ODRV may be the same as that during the printing job. In the ink jet printer of a type which is able to generate a plurality of types of raw signals ODRV having different waveforms, the row signal ODRV ejecting a largest amount of ink drops may be selected from the plurality of types of raw signals ODRV for use. In other words, a pulse (voltage) having a largest amplitude is selected from pulses to be applied to the piezoelectric element 48. With this configuration as well, increase of the speed of ejecting the ink drops from the nozzle row 43 is achieved. The amount of ink consumption when all the nozzles 23 of the nozzle row 43 are driven by the nozzle inspection routine is relatively small (for example, 0.1 g or 0.2 g). FIG. 10 shows a state in which the air bubble accumulated in the filter chamber 96 of the ink supply needle 90 is deformed when all the nozzles in the nozzle row 42 as the inspection target are driven at a highest drive frequency. As shown in the drawing, when no nozzle 23 in the nozzle row 43 is driven, the air bubble in the filter chamber 96 of the ink supply needle 90 has a spherical shape (see FIG. 10(*a*)). From this state, when all the nozzles 23 in the nozzle row 43 as the inspection target are driven at the highest drive frequency, the flow rate of the ink flowing in the internal channel 92 is increased correspondingly, and the air bubble is crushed by the filter 94 (see FIG. 10(*b*)). When the air bubble exceeds the predetermined size, the internal channel 92 of the ink supply needle 90 is closed by the deformed air bubble. Therefore, the ink from the ink cartridge 26 is not supplied to the ink chambers 29 in the respective nozzles 23, and hence the ink drops are not ejected from almost all the nozzles 23 (see FIG. 10(*c*)). Therefore, inspection of the degree of the growth of the air bubble in the filter chamber 96 is achieved by detecting the presence or absence of ejection of the ink drops from the nozzle row 43. When the driving of all the nozzles 23 is stopped, the deformed air bubble is restored to their original shape (spherical shape). The predetermined period means a period from the moment when all the nozzles 23 are started to be driven until the moment when the internal channel 92 of the ink supply needle 90 is closed by the deformation of the air bubble and hence the ejection of the ink drop from the nozzle 23 is stopped in the case in which the air bubble in the filter chamber 96 is large, and the value which is specified experimentally in advance is used.

Then, the nozzles 23 of the nozzle row 43 as the inspection target is driven (Step S265), an output level Vout of the output signal waveform from the voltage detection circuit 54 is entered (Step S270), and the entered output level Vout and a threshold value Vref are compared (Step S280). When the output level Vout is the threshold value Vref or larger, it is determined that there is no nozzle defect in the nozzle row 23 (Step S290), then, this routine is ended. When the output level Vout is smaller than the threshold value Vref, it is determined that all or some of the nozzle row 23 are defective (Step S300), and this routine is ended. Here, as shown in FIG. 7, since the nozzle plate 27 of the printhead 24 is applied with a voltage by the voltage application circuit 53, charged ink drops are ejected from the nozzles 23. Therefore, when the charged ink drops splashed and land the inspection area 52, the electrical state is changed on the nozzle plate 27, which is detected as the output signal waveform by the voltage detection circuit 54. The amplitude of the output signal waveform depends on the present or absence or the size of the splashed ink drops, and is smaller than the normal case or is zero when the nozzles 23 are clogged and hence the ink drops do not splash, or when the ink drops are smaller than the predetermined size. Therefore, determination of the presence or absence of clogging of the nozzles 23 is achieved on the basis of the output level Vout by detecting the amplitude of the output signal waveform, that is, the output level Vout. The amplitude of the output signal waveform is feeble for the eject of one shot of ink drop. However, all the nozzles 23 of the nozzle row 43 are driven simultaneously at the first to third pulses P1 to P3, the output signal waveform having a sufficiently large amplitude is obtained from the voltage detection circuit 54 when the ink drops are ejected from all the nozzles 23. On the other hand, since all the nozzles 23 of the nozzle row 43 receive supply of ink via the internal channel 92 of the ink supply needle 90, when the internal channel 92 is closed by the air bubble deformed by the nozzle inspection described above, it is basically considered that the all the nozzles 23 become defective, and the amplitude of the output signal waveform detected by the voltage detection circuit 54 becomes substantially zero. Therefore, the threshold value Vref may be determined so as to be capable of discriminating these states. In Step S265, all the nozzles 23 may be driven, or some of the nozzles 23 may be driven. In such a case, the threshold value Vref is determined according to the number of nozzles 23 to be driven. The drive frequency of the nozzles 23 does not have to be the maximum frequency as in Step S240 as well, and the same drive frequency as that during the printing job may be used. The nozzle inspection routine has been described thus far.

Returning back to Step S150 of the main routine in FIG. 8, when the nozzle inspection routine is performed and it is determined that there is the nozzle defect (Step S160), it is determined that the air bubble in the filter chamber 96 of the ink supply needle 90 might close the internal channel 92 during the printing job, and hence the air bubble is needed to be ejected to the outside, so that the head cleaning is performed (Step S170) and, after having performed the cleaning, the timer value T1 is reset to the value 0 (Step S180), and the inspection request flag F is set to the value 0 (Step S190) to end this routine. The cleaning is achieved by closing the air release valve 46 in a state in which the printhead 24 is sealed by the capping member 41, and activating the suction pump 45. Accordingly, the air bubble in the filter chamber 96 passes the filter 94 and is discharged to the outside. However, the amount of ink consumption in association with performance of the cleaning is extremely larger in comparison with the amount of ink consumption in association with the performance of the nozzle inspection routine described above (2 g, 3 g, or 4 g, for example). The cleaning is performed for all the nozzle rows 43 also when there is the nozzle defect in the nozzle row 43 as the inspection target. It is based on the consideration such that the air bubbles in the filter chambers 96 in the respective colors are grown in the uniform speed. It is also possible to perform the cleaning specifically for the nozzle row 43 as the inspection target. In this case, the capping member 41 may be configured so as to be capable of sealing the printhead 24 for each nozzle row 43.

Figure 11:
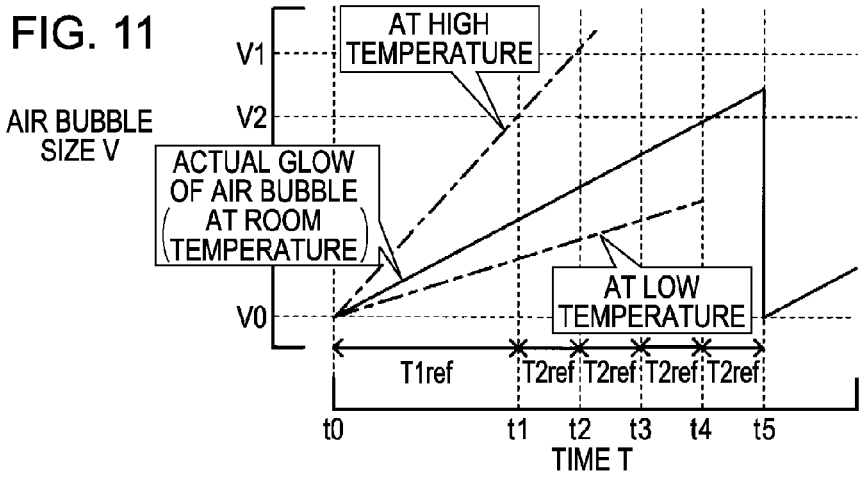
FIG. 11 is an explanatory drawing showing a relation between the size of the air bubble and the elapsed time.

In contrast, when it is determined that there is no nozzle defect in the nozzle inspection routine (Step S160), the air bubble in the filter chamber 96 of the ink supply needle 90 is not grown to an extent that might close the internal channel 92 during the printing job, so that it is determined that the cleaning is not needed, and the timer value T2 is reset (Step S200) to end this routine. In this case, when the main routine is performed from the next time onward, the timer value T1 is determined to be the threshold value T1ref or larger in Step S110, and the inspection request flag F is determined to be the value 1 in Step S120. Therefore, the timer value T2 and a threshold valve T2ref are compared (Step S140) and, when the timer value T2 is the threshold value T2ref or larger, the nozzle inspection routine in FIG. 9 is performed again for checking the degree of the growth of the air bubble in the filter chamber 96 of the ink supply needle 90 (Step S150). When there is the nozzle defect, the cleaning for discharging the air bubble grown in the filter chamber 96 is performed and the timer value T1 is reset and the inspection request flag F is set to the value 0 (Step S170 to S190), and when there is no nozzle defect, the timer value T2 is reset (Step S200) to end this routine. The threshold value T2ref specifies the time interval of the performance of the nozzle inspection routine and is set to be every two weeks, for example. In this manner, when a period which corresponds to the threshold value T1ref (one month, for example) is elapsed from the performance of the previous cleaning, the nozzle inspection routine in FIG. 9 is performed at a time interval (every two weeks, for example) which corresponds to the threshold value T2ref to confirm the degree of the growth of the air bubble in the filter chamber 96 of the ink supply needle 90 and, when there is the nozzle defect, it is determined that the air bubble is grown enough, and the cleaning for discharging the air bubble to the outside is performed. FIG. 11 shows a state of a change of the size of the air bubble in the filter chamber 96 with time. In FIG. 11, the sign "V1" indicates the size of the air bubble which causes the nozzle defect when the nozzle row 43 is normally driven for printing, and the sign "V2" indicates the size of the air bubble which causes the nozzle defect when the nozzle row 43 is driven at the maximum frequency according to the nozzle inspection routine shown in FIG. 9. The sign "t5" designates the time when the cleaning is performed. As shown in the drawing, the size of the air bubble in the filter chamber 96 is increased gradually with the elapse of time. A relation between the size V of the air bubble in the filter chamber 96 and the elapsed time T is shown in the following expression (1). The "Vo" in the expression (1) indicates the size of the air bubble in the initial state immediately after the performance of the cleaning, and "K" designates the speed of growth of the air bubble. The speed of growth of the air bubble varies depending on the environment of usage of the ink jet printer 20 and, for example, the speed is faster at a high temperature than at a low temperature. Therefore, when the nozzle inspection routine is not performed, it is necessary to perform the cleaning at an earlier timing so as to prevent the air bubble from closing the internal channel 92 of the ink supply needle 90 even when the air bubble is grown at the highest growing speed irrespective of the environment in which the ink jet printer is situated. In this case, however, the frequency of performance of the cleaning is increased, and the amount of ink consumption is increased. Therefore, the frequency of performance of the cleaning which consumes a large amount of ink is reduced by performing the nozzle inspection routine which consumes the ink significantly smaller than the cleaning and performing the cleaning while confirming the degree of growth of the air bubble in the filter chamber 96, whereby the entire amount of ink consumption is restrained from increasing. More specifically, in order to prevent the nozzle defect from occurring during the printing job, it is necessary to perform the cleaning before the air bubble is grown to the size V1, and when the air bubble is grown at the highest growing speed, that is, at a high temperature, the period required for the air bubble to grow from the initial size V0 to the size V2 is the threshold value T1ref, and the period required for the air bubble from growing from the size V2 to the size V1 is the threshold value T2ref. Therefore, in this case, the cleaning is performed when the elapsed time from the performance of the previous cleaning reaches the threshold value T1ref. In contrast, at a room temperature or a low temperature, since the growing speed of the air bubble is slower than at a high temperature, the air bubble is not grown to the size V2 which might cause the nozzle defect by the nozzle inspection routine even when the elapsed time from the performance of the previous cleaning exceeds the threshold valve T1ref, so that the cleaning may be retarded to the timing of the threshold value T1ref or onward. At this time, since the threshold value T2ref is determined to be the period required for the air bubble to grow from the size V2 to the size V1 when the air bubble is grown at the highest growing speed, if the nozzle defect is not found in the nozzle inspection routine by performing the nozzle inspection routine at the time interval of the threshold value T2ref (performing at times t1, t2, t3, t4 and t5), there is no chance of occurring the nozzle defect during the printing job within the period to the threshold value T2ref from then onward. In other words, the threshold value T2ref may be considered as a margin period for preventing the nozzle defect from occurring during the printing job. In the example shown in FIG. 11, the nozzle defect is occurred when the elapsed time from the performance of the previous cleaning exceeds the threshold value T1ref and the nozzle inspection routine is performed five times at the time interval of the threshold value T2ref, and hence the cleaning is performed. In this manner, by determining the above-described threshold value T1ref or the threshold value T2ref, the sized V1, V2, and the respective parameters in the method of driving the nozzle rows 43 in the nozzle inspection routine are specified experimentally, the cleaning at the optimal timings is achieved so as to avoid the wasteful consumption of the ink.

As a method of setting the respective parameters as described above, various methods such as specifying the threshold value T1ref first and then specifying the threshold value T2ref or the size V2 which match therewith, or specifying the threshold value T2ref first and then specifying the threshold value T1ref or the size V2 which match therewith may be employed.

$$V=V_0+K\cdot T \quad (1)$$

When the timer value T1 is determined to be smaller than the predetermined time T1ref in Step S110, or when the timer value T2 is determined to be smaller than the predetermined time T2ref in Step S140, whether the second inspection timing has come or not is determined (Step S202) and, when the second inspection timing has not come yet, this routine is ended and, when the second inspection timing has come, the second nozzle inspection routine is performed (Step S204). As the timing of performing the second nozzle inspection, when the printing job is accepted, when printing job of one page is completed, or when the printing job of a predetermined number of pages is completed are applicable. The second nozzle inspection routine is intended to inspect whether or not the clogging occurs at the openings of the respective nozzles 23 of the nozzle row 43 and, for example, is performed by moving the carriage 22 to the home position (inspection area 52), applying a voltage to the nozzle plate 27 by the voltage application circuit 53 and ejecting ink drops individually from the respective nozzles 23 of the nozzle row 43 as the inspection target in a state in which the inspection area 52 of the capping member 41 is grounded, detecting the change of the electric state generated in the inspection area 52 by the voltage detection circuit 54, and detecting the defective ejection of the nozzles 23 individually. The drive frequency of the nozzles 23 used here is the same drive frequency used during the printing job. Therefore, the flow rate of the ink flowing in the internal channel 92 of the ink supply needle 90 is slower than the flow rate of the ink flowing in the internal channel 92 in the nozzle inspection routine in FIG. 9. When all the nozzles 23 are normal as a result of the second nozzle inspection (Step S206), this routine is ended without doing anything and, when the defective ejection exists in any nozzles 23 (Step S206), a relatively small amount of ink is sucked as described above to perform the cleaning for solving the clogging of the opening of the nozzle 23 (second cleaning) (Step S208), whereby ending this routine.

Figure 12:
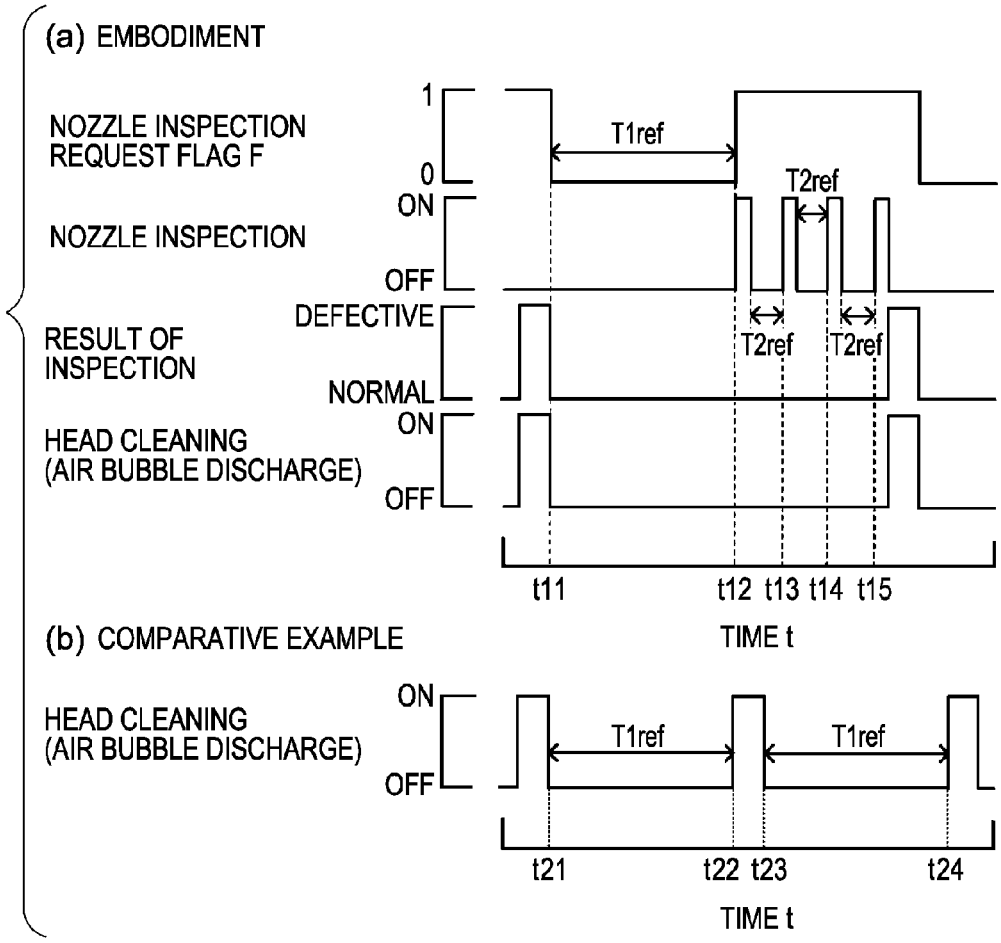
FIG. 12 is a time chart showing the timing of performance of head cleaning.

FIG. 12 shows a time chart showing the timing of performance of the cleaning. As shown in the drawing, in the embodiment, when the predetermined period T1ref is elapsed from the performance of the previous cleaning, the nozzle inspection routine is performed at the predetermined time interval T2ref until the nozzle defect occurs. When the nozzle defect occurs, it is determined that the air bubble in the filter chamber 96 of the ink supply needle 90 is grown to an extent which might close the internal channel 92, and the cleaning is performed. Therefore, the frequency of performance of the cleaning is a time interval including the period until the nozzle defect occurs in the nozzle inspection routine added to the predetermined time T1ref. In the example shown in FIG. 12, the nozzle defect is occurred when the nozzle inspection routine is performed four times at the interval of the predetermined time T2ref after having elapsed the predetermined time T1ref, and the cleaning is then performed. In contrast, in the comparative example, since the state of the air bubble in the filter chamber 96 cannot be grasped, the cleaning is performed again at the interval of the predetermined time T1ref from the performance of the previous cleaning. In this manner, in this embodiment, reduction of the frequency of performance of the cleaning is achieved in comparison with the comparative example.

Here, the correspondence between the components in this embodiment and the components in the present invention will be clarified. The printhead 24 in this embodiment corresponds to the "head", the nozzle inspection apparatus 50 and the controller 70 for performing the nozzle inspection routine in FIG. 9 correspond to the "ejecting state inspecting unit", and the capping member 41, the suction pump 45, and the controller 70 for performing Step S180 in the main routine in FIG. 8 correspond to the "cleaning performing unit". In this embodiment, an example of the method of controlling the liquid ejecting apparatus in the present invention is apparently described by explaining the operation of the ink jet printer 20.

According to the ink jet printer 20 described in detail above, when the predetermined time T1ref (one month, for example) has elapsed from the performance of the previous cleaning, the flow rate in the filter chamber 96 of the ink supply needle 90 is increased to drive all the nozzles 23 of the nozzle row 43 as the inspection target at the drive frequency of the maximum frequency so that the air bubble is crushed by the filter 94, and the nozzle inspection for determining whether or not the defect is occurred in the nozzles 23 is repeatedly performed at the interval of the predetermined time T2ref until the nozzle defect occurs and, when the nozzle defect is occurred in the nozzle inspection, the cleaning for discharging the air bubble in the filter chamber 96 of the ink supply needle 90 to the outside is performed. Therefore, reduction of the frequency of performance of the cleaning which consumes a large amount of ink in comparison with the nozzle inspection is achieved. Consequently, increase of the entire amount of ink consumption is reduced. In addition, in the nozzle inspection, the nozzle row 43 which corresponds to the ink which remains most from the respective colors of ink is determined to be the inspection target, and hence variations in remaining amount of ink among the respective colors may be restrained. In addition, the nozzle inspection is performed by applying a voltage to the nozzle plate 27 by the voltage application circuit 53, grounding the inspection area 52 of the capping member 41 and, in this state, ejecting the ink drops from the nozzle rows 43, and detecting the change in electrical state generated in the inspection area 52 by the voltage detection circuit 54. Therefore, the defective ejection is detected relatively easily even when the ink drops are ejected from all the nozzles 23 of the nozzle row 43 at once.

In this embodiment, the ejecting state of the ink drops is inspected by driving all the nozzles 23 of the nozzle row 43 as the inspection target at the maximum drive frequency in the nozzle inspection routine in FIG. 9. However, since what is important is to crush the air bubble in the filter chamber 96 of the ink supply needle 90 against the filter 94, the nozzles 23 may be driven at a drive frequency slightly lower than the maximum frequency, or some of the nozzles in the nozzle row 43 as the inspection target might not be driven depending on the cases.

In this embodiment, the ejecting state of the ink drops from the nozzles 23 is inspected by driving all the nozzles 23 in the nozzle row 43 as the inspection target at the maximum drive frequency in the nozzle inspection routine in FIG. 9. However, the ejecting state of the ink drops from the nozzles 23 may be inspected by pressurizing the internal channel 92 of the ink supply needle 90 corresponding to the nozzle row 43 as the inspection target from the upstream side using the pump, not shown and then driving all the nozzles 23 or some of the nozzles 23 in the nozzle row 43 as the inspection target or, alternatively, the ejecting state of the ink drops from the nozzles 23 may be inspected by sealing the nozzle row 43 as the inspection target with the capping member 41 to close the air release valve 46, driving the suction pump 45 to depressurize the sealed space, then releasing the sealing of the capping member 41 and driving all the nozzles 23 or some of the nozzles 23 in the nozzle row 43 as the inspection target. In these cases as well, the flow rate in the internal channel 92 of the ink supply needle 90 may be increased in comparison with that during the printing job, and the air bubble in the filter chamber 96 can be crushed against the filter 94, so that the nozzle inspection as in this embodiment is performed. The magnitude of the pressurization or the duration of pressurization of the former case, or the magnitude of the depressurization and the duration of depressurization may be determined experimentally to an extent which is able to crush the air bubble by increasing the flow rate i the internal channel 92 of the ink supply needle 90.

In this embodiment, the nozzle inspection is performed with respect to the nozzle row having the largest amount of remaining ink from among the nozzle rows 43 for the respective colors in the nozzle inspection routine in FIG. 9. However, the present invention is not limited thereto, and the nozzle inspection may be performed with respect to a specific nozzle row 43 (black K, for example) irrespective of the amount of remaining ink, or the cleaning may be performed only for the nozzle row in which the nozzle defect is found after having performed the nozzle inspection for all the nozzle rows 43 as the target inspection. In the latter case, the inspection may be performed for all the nozzle rows 43 at the same timing, or at different timings. For example, the nozzle inspection may be performed by shifting the timing at the interval of one week.

In this embodiment, the nozzle inspection routine in FIG. 9 is performed at the predetermined time interval T2ref. However, the present invention is not limited to the performance at the predetermined time interval T2ref and, for example, may be performed before starting printing when the printing command is issued. In this embodiment, the nozzle inspection routine in FIG. 9 is performed immediately after having elapsed the predetermined time T1ref from the performance of the previous cleaning, or immediately after having elapsed the predetermine time T2ref after having performed the previous nozzle inspection routine (no nozzle defect occurred). However, the present invention is not limited to a mode of performing immediately after and, for example, it is also applicable to wait until the printing command is issued, and perform the same before starting the printing job.

In this embodiment, the nozzle inspection is performed by allowing the ink to land on the inspection area 52 in the capping member 41 in a state in which the nozzle plate 27 and the capping member 41 of the printhead 24 are brought into contact with each other via the sealing member 41*a*. However, the inspection area 52 may be provided at a position other than the capping member 41. For example, an inspection area may be provided at the left end or the right end of the platen 44 additionally in FIG. 1. Alternatively, a flashing area may be formed at a left end at a position deviated from the printable area in the platen 44, and uses the flashing area as the inspection area. The flashing area is used when performing so-called a flashing operation which causes ink drops to be ejected irrespective of the printing data at a regular or predetermined timing for preventing the ink from drying and solidifying at a distal end of the nozzles 23.

In this embodiment, a voltage is applied to the printhead 24 and the inspection area 52 is grounded to a ground potential. However, it is also possible to ground the printhead 24 to the ground potential to apply the voltage to the inspection area 52. However, when the inspection area 52 is provided not in the interior of the capping member 41, but at an opened position, a current might leak due to accumulated ink present around the inspection area, so that a sufficient magnitude of potential different might not be generated between the printhead 24 and the inspection area. However, such probability is avoided when the voltage is applied to the printhead 24 and the inspection area is grounded to a ground potential.

In this embodiment, the upper ink absorber 55 is formed of a sponge having conductivity. However, it is also possible to make the same with a sponge having no conductivity and make it wet with water or ink before the ink ejection inspection to provide the conductivity. The upper ink absorber 55 may be omitted without problem.

In this embodiment, the voltage detection circuit 54 is adapted to detect the change of the electrical state on the side of the printhead 24. However, it may be adapted to detect the change of the electrical state on the side of the inspection area 52.

In this embodiment, the nozzle inspection is performed by applying a voltage to the nozzle plate 27 by the voltage application circuit 53, grounding the inspection area 52 of the capping member 41 and, in this state, ejecting ink drops from the nozzle rows 43, thereby detecting the change of the electrical state generated in the inspection area 52 by the voltage detecting circuit 54. However, the present invention is not limited thereto and, for example, the nozzle inspection may be performed by arranging a light-receiving element and a light-emitting element so that a laser traverse across a splashing paths of the ink drops from the nozzle row 43 and determining whether the laser outputted from the light-emitting element enters the light-receiving element or not, or alternatively, the nozzle inspection is performed by transporting the printing sheet S and ejecting the ink drops from the nozzle row 43 as the inspection target to print an inspection mark and reading the printed mark with a photo sensor. In the former case and the latter case, whether or not the ink drops are ejected normally from the nozzles 23 may be judged by drive-controlling the nozzles 23 so as to increase the flow rate in the internal channel 92 of the ink supply needle 90 (drive controlling at the maximum frequency) rather than controlling the nozzles 23 during the printing job, and then driving the nozzles 23 of the nozzle row 43 by the same control as during the printing job or, alternatively, it is also possible to drive-control the nozzles 23 so as to increase the flow rate in the internal channel 92 of the ink supply needle 90 rather than to control the nozzles 23 during the printing job, and judge whether or not the ink drops are ejected normally from the nozzles 23 while continuing this drive control.

In this embodiment, the description has been given to the ink jet printer which ejects ink drops on the printing sheet S in association with the movement of the printhead 24 in the primary scanning direction. However, it may be applied to the ink jet printer having nozzles arranged by a width corresponding to the width of the printing sheet S, which is, so-called a line head.

In this embodiment, the ink jet printer is shown as an example of an ink jet printing apparatus in the present invention. However, the present invention is not specifically limited as long as it is an apparatus in which the ink jet printing system is employed and, for example, the present invention may be applied to OA equipment such as facsimile apparatuses or multifunctional peripherals as well as manufacturing apparatus for manufacturing devices such as color filters.

In the embodiment described above, an example in which the liquid ejecting apparatus in the present invention is embodied in the ink jet printer 20 has been described. However, it may be embodied in the liquid ejecting apparatus which ejects liquid other than the ink (including liquid material in which particles of functional material are dispersed (dispersion liquid) or fluid such as gel). For example, liquid ejecting apparatuses which eject liquid including material such as electrode material or color material used for manufacturing liquid crystal displays, EL (electroluminescence) displays, surface emission displays and color filters, dissolved therein, liquid ejecting apparatuses which eject liquid material having the same material dispersed therein, or liquid ejecting apparatuses which eject liquid used as a precise pipette and serves as a sample. Alternatively, liquid ejecting apparatuses which ejects lubricant to precise machines such as watches or camera at pinpoint, liquid ejecting apparatuses which eject transparent resin liquid such as an UV-cured resin or the like on a substrate for forming minute semispherical lenses (optical lenses) used for optical communication elements or the like, liquid ejecting apparatuses which eject etching liquid such as acid or alkali for etching the substrate or the like, or liquid ejecting apparatuses which eject gel.

Although the embodiments of the present invention has been described thus far, the present invention is not limited to the embodiments shown above, and various modifications may be made without departing from the technical field of the present invention.

What is claimed is:

1. A liquid ejecting apparatus that ejects liquid on a target comprising:

a head having a liquid storage portion for storing the liquid, a nozzle row that ejects the liquid, and a liquid supply channel that supplies the liquid stored in the liquid storage portion to the nozzle row;

a ejecting state inspecting unit that controls the flow rate of the liquid supply channel to achieve an inspection flow rate which is faster than the flow rate in the liquid supply channel when ejecting the liquid to the target at predetermined timing and performs a ejecting state inspection for detecting the ejecting state of the liquid from the nozzle row; and a cleaning performing unit that performs the head cleaning when a defective ejection of the liquid from the nozzle row is detected by the ejecting state inspecting unit and does not perform the head cleaning when the defective ejection of the liquid from the nozzle row is not detected by the ejecting state inspecting unit.

2. The liquid ejecting apparatus according to claim 1, wherein the ejecting state inspecting unit controls the flow rate in the liquid supply channel at the inspection flow rate during a period in which air bubble having a predetermined size clogs the interior of the liquid supply channel to perform the ejecting state inspection.

3. The liquid ejecting apparatus according to claim 1, wherein the ejecting state inspecting unit drives and controls the head at a drive frequency in a frequency range higher than the case of ejecting the liquid to the target to perform the ejecting state inspection.

4. The liquid ejecting apparatus according to claim 1, wherein the ejecting state inspecting unit drives and controls the head to eject the liquid from approximately 100% of the nozzle row to perform the ejecting state inspection.

5. The liquid ejecting apparatus according to claim 1, wherein the ejecting state inspecting unit drives and controls the head so as to eject the liquid from the nozzle row at a higher rate than the case of ejecting the liquid to the target.

6. The liquid ejecting apparatus according to claim 1, wherein the ejecting state inspecting unit is a unit that controls the flow rate in the liquid supply channel to be the inspection flow rate by pressurizing the liquid from the upstream side of the liquid supply channel.

7. The liquid ejecting apparatus according to claim 1, wherein the ejecting state inspecting unit is a unit that controls the flow rate in the liquid supply channel to be the inspection flow rate by sealing ejection ports of the nozzle row and depressurizing the same.

8. The liquid ejecting apparatus according to claim 1, wherein the ejecting state inspecting unit is a unit that performs the ejecting state inspection when a first predetermined time has elapsed from the performance of the previous cleaning by the cleaning performing unit as the predetermined timing and, when the defective ejection is not detected by the inspection, performs the ejecting state inspection every time when a second predetermined time, which is shorter than the first predetermined time, has elapsed until the defective ejection is detected.

9. The liquid ejecting apparatus according to claim 8, wherein the first predetermined period is set on the basis of the growing speed of the air bubble under the conditions that the air bubble in the liquid supply channel grows most rapidly.

10. The liquid ejecting apparatus according to claim 1, comprising:

a second ejecting state inspecting unit that controls the flow rate of the liquid supply channel so as to be a second inspection flow rate slower than the inspection flow rate at a timing different from the predetermined timing; and a second cleaning performing unit that performs the head cleaning in association with consumption of the liquid of an amount smaller than that by the cleaning performing unit when the defective ejection of the liquid from the nozzle row is detected by the second ejecting state inspecting unit and does not perform the head cleaning when the defective ejection of the liquid from the nozzle row is not detected by the ejecting state inspecting unit.

11. The liquid ejecting apparatus according to claim 1, wherein the head includes a plurality of liquid storage portions for storing liquid in various colors, a plurality of nozzle rows that eject various colors of liquid, and a plurality of liquid flow channels that supply liquid stored in the plurality of liquid storage portions to the corresponding nozzle rows, the ejecting state inspecting unit is a unit that performs the ejecting state inspection for the plurality of nozzle rows at timings different from each other, and the cleaning performing unit is a unit that performs the cleaning for the nozzle row at which the defective ejection is detected by the ejecting state inspecting unit.

12. The liquid ejecting apparatus according to claim 1, wherein the head includes a plurality of liquid storage portions for storing liquid in various colors, a plurality of nozzle rows that eject various colors of liquid, and a plurality of liquid flow channels that supply liquid stored in the plurality of liquid storage portions to the corresponding nozzle rows, the ejecting state inspecting unit is a unit that detects the liquid ejecting state from a predetermined nozzle row from among the plurality of nozzle rows, and the cleaning performing unit is a unit that performs the cleaning for all the plurality of nozzle rows when the defective ejection is detected at the predetermined nozzle row by the ejecting state inspecting unit.

13. A method of controlling a liquid ejecting apparatus having a head having a liquid storage portion for storing liquid, a nozzle row that ejects the liquid, and a liquid supply channel that supplies the liquid stored in the liquid storage portion to the nozzle row and ejecting liquid on a target comprising;

(a) controlling the flow rate of the liquid supply channel to achieve an inspection flow rate which is faster than the flow rate in the liquid supply channel when ejecting the liquid to the target at predetermined timing and performing an ejecting state inspection for detecting the ejecting state of the liquid from the nozzle row; and (b) performing head cleaning when a defective ejection of the liquid from the nozzle row is detected by the step (a) and not performing the head cleaning when the defective ejection of the liquid from the nozzle row is not detected by an ejecting state inspecting unit.

14. A liquid ejecting apparatus that ejects liquid on a target comprising:

a head having a liquid storage portion for storing the liquid, a nozzle row that ejects the liquid, and a liquid supply channel that supplies the liquid stored in the liquid storage portion to the nozzle row;

a ejecting state inspecting unit that controls the flow rate of the liquid supply channel to achieve an inspection flow rate which is faster than the flow rate in the liquid supply channel when ejecting the liquid to the target at predetermined timing and performs a ejecting state inspection for detecting the ejecting state of the liquid from the nozzle row; and a cleaning performing unit that performs the head cleaning when a defective ejection of the liquid from the nozzle row is detected by the ejecting state inspecting unit and does not perform the head cleaning when the defective ejection of the liquid from the nozzle row is not detected by the ejecting state inspecting unit, wherein the ejecting state inspecting unit is a unit that performs the ejecting state inspection when a first predetermined time has elapsed from the performance of the previous cleaning by the cleaning performing unit as the predetermined timing and, when the defective ejection is not detected by the inspection, performs the ejecting state inspection every time when a second predetermined time, which is shorter than the first predetermined time, has elapsed until the defective ejection is detected.

15. A method of controlling a liquid ejecting apparatus having a head having a liquid storage portion for storing liquid, a nozzle row that ejects the liquid, and a liquid supply channel that supplies the liquid stored in the liquid storage portion to the nozzle row and ejecting liquid on a target comprising;

(a) controlling the flow rate of the liquid supply channel to achieve an inspection flow rate which is faster than the flow rate in the liquid supply channel when ejecting the liquid to the target at predetermined timing and performing an ejecting state inspection for detecting the ejecting state of the liquid from the nozzle row; and (b) performing head cleaning when a defective ejection of the liquid from the nozzle row is detected by the step (a) and not performing the head cleaning when the defective ejection of the liquid from the nozzle row is not detected by an ejecting state inspecting unit, wherein the ejecting state inspecting unit is a unit that performs the ejecting state inspection when a first predetermined time has elapsed from the performance of the previous cleaning by a cleaning performing unit as the predetermined timing and, when the defective ejection is not detected by the inspection, performs the ejecting state inspection every time when a second predetermined time, which is shorter than the first predetermined time, has elapsed until the defective ejection is detected.

* * * * *